US009605481B1

(12) United States Patent
Bleeker

(10) Patent No.: US 9,605,481 B1
(45) Date of Patent: Mar. 28, 2017

(54) DOWNHOLE ADJUSTABLE DRILLING INCLINATION TOOL

(71) Applicant: Smart Downhole Tools B.V., Alkmaar (NL)

(72) Inventor: Johannes Thomas Bleeker, Hilversum (NL)

(73) Assignee: SMART DOWNHOLE TOOLS B.V. (NL)

( * ) Notice: Subject to any disclaimer, the term of this patent is extended or adjusted under 35 U.S.C. 154(b) by 0 days.

(21) Appl. No.: 15/214,690

(22) Filed: Jul. 20, 2016

(51) Int. Cl.
*E21B 7/06* (2006.01)
*E21B 21/08* (2006.01)
*E21B 47/024* (2006.01)
*E21B 3/00* (2006.01)

(52) U.S. Cl.
CPC ..... *E21B 7/062* (2013.01); *E21B 3/00* (2013.01); *E21B 21/08* (2013.01); *E21B 47/024* (2013.01)

(58) Field of Classification Search
CPC ..... E21B 7/062; E21B 7/067
USPC ..... 175/74, 61
See application file for complete search history.

(56) References Cited

U.S. PATENT DOCUMENTS

| | | | | |
|---|---|---|---|---|
| 4,884,643 | A | 12/1989 | Wawrzynowski et al. | |
| 5,503,235 | A * | 4/1996 | Falgout, Sr. | E21B 23/006 175/107 |
| 6,328,119 | B1 | 12/2001 | Gillis et al. | |
| RE39,970 | E | 1/2008 | Askew | |

FOREIGN PATENT DOCUMENTS

| | | | | |
|---|---|---|---|---|
| AU | 2013399114 | A | 2/2016 | |
| CA | 1157005 | A1 | 11/1983 | |
| CA | 2072552 | A1 | 12/1992 | |
| EP | D497421 | A1 | 8/1992 | |
| GB | 2442303 | A | 4/2008 | |
| GB | WO 2008037947 | A1 * | 4/2008 | E21B 7/067 |
| WO | 2008037947 | A1 | 4/2008 | |
| WO | 2010016862 | A1 | 2/2010 | |
| WO | 2014137543 | | 3/2015 | |
| WO | 2015057217 | | 3/2016 | |
| WO | 2016043719 | A1 | 3/2016 | |

* cited by examiner

*Primary Examiner* — George Gray

(74) *Attorney, Agent, or Firm* — Basil M. Angelo; Angelo Mikeska PLLC

(57) ABSTRACT

A downhole adjustable drilling inclination tool including an outer housing, an inner housing, a compression spring, a piston assembly, and a tilt housing. The piston assembly is fluidly controlled to move axially along the outer diameter of a bottom end portion of the inner housing so that a rotatable control ring moves about a guide pin to hold a neutral, straight, or bent position of the piston assembly corresponding to an amount of compression of the compression spring. The tilt housing partially disposed within the outer housing includes a bolt plate pin channel configured to receive a bolt plate pin of the piston assembly that travels to tilt the tilt housing by a tilting mechanism that connects the tilt housing to the outer housing and position the tilt housing in a neutral, straight, or bent position corresponding to the neutral, straight, or bent position of the piston assembly.

16 Claims, 42 Drawing Sheets

01079-000002 US

REPLACEMENT SHEET

*13/42*

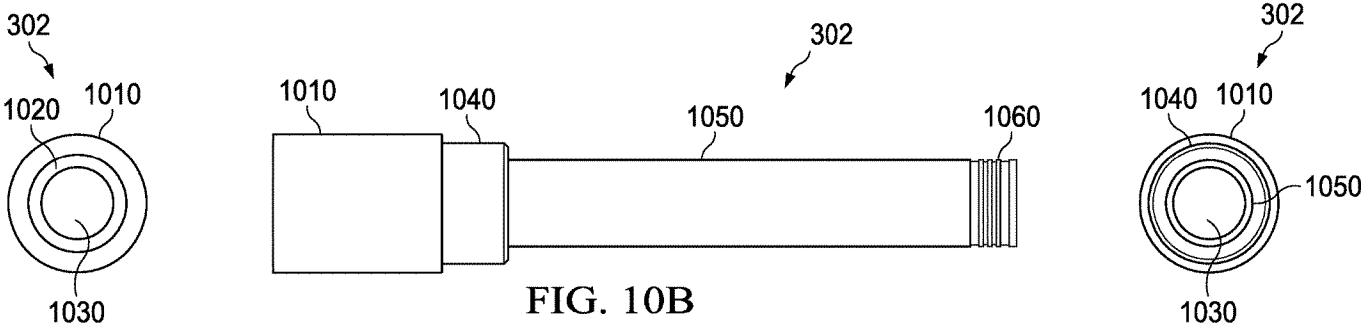
FIG. 10A
FIG. 10B
FIG. 10C
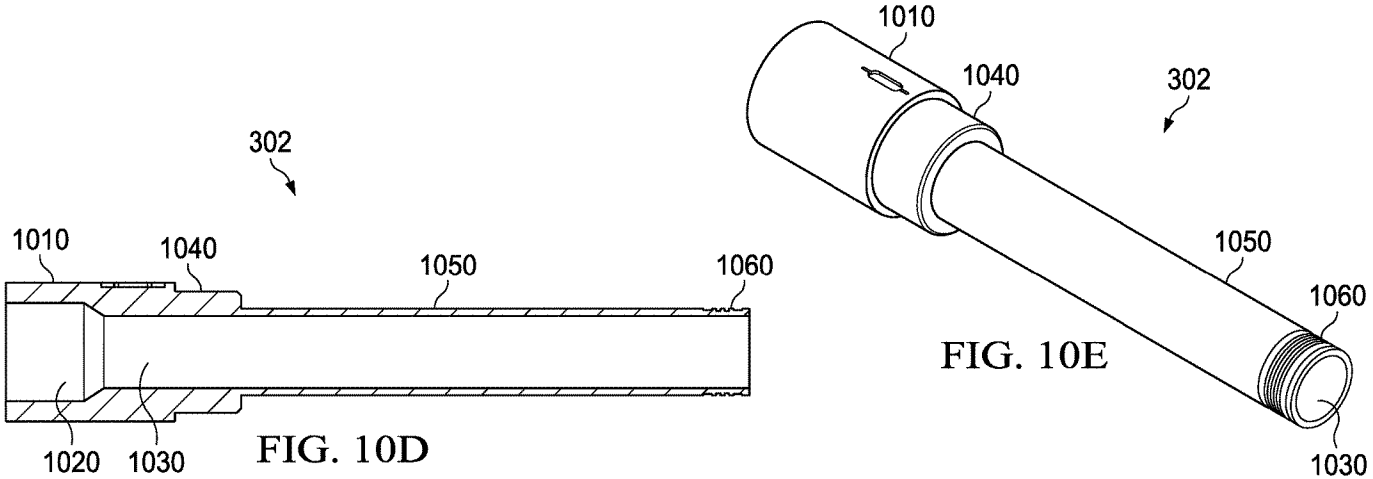
FIG. 10D
FIG. 10E

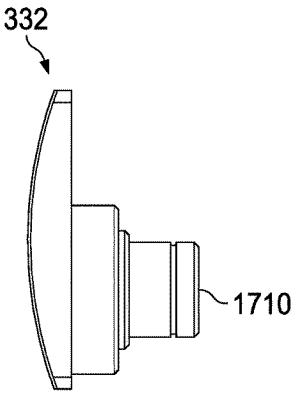
FIG. 17A
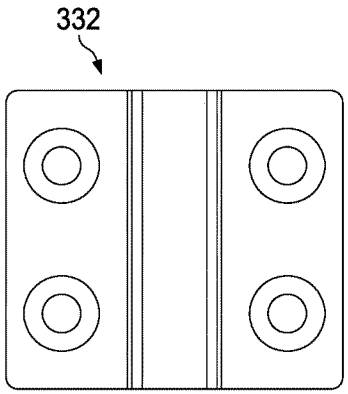
FIG. 17B
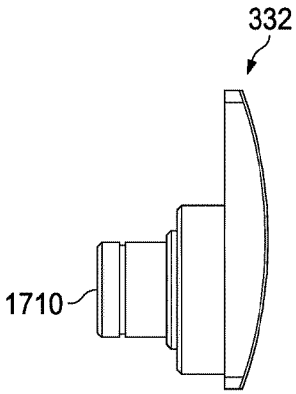
FIG. 17C
FIG. 17D
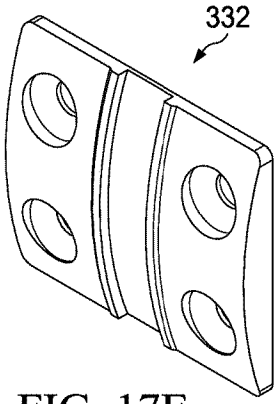
FIG. 17E
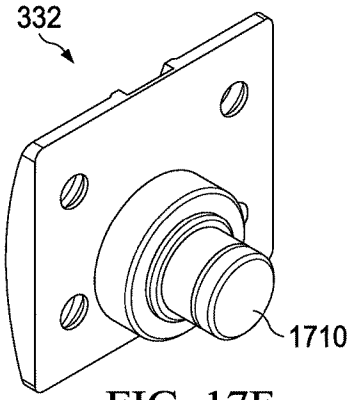
FIG. 17F

DOWNHOLE ADJUSTABLE DRILLING INCLINATION TOOL

BACKGROUND OF THE INVENTION

Conventional drilling systems drill a substantially straight wellbore to recover geothermal energy or oil and gas reserves disposed below the Earth's surface. However, certain reserves are not accessible via straight wellbores for a variety of reasons, including, for example, lack of vertical access over a given reserve and geological composition and structure that form barriers to straight drilling operations. To access geothermal energy, and more difficult to reach oil and gas reserves, a non-linear well trajectory is required. Directional drilling systems seek to address the limitations of conventional drilling systems by drilling certain sections of a wellbore in a directional, or slanted, manner that deviates from the vertical longitudinal axis of the wellbore by an inclination angle. In this way, a wellbore having a combination of vertical and non-vertical sections may be drilled, providing access to geothermal energy or remote and more difficult to reach oil and gas reserves.

BRIEF SUMMARY OF THE INVENTION

According to one aspect of one or more embodiments of the present invention, a downhole adjustable drilling inclination tool includes an outer housing, an inner housing, a compression spring, a piston assembly, and a tilt housing. The piston assembly is fluidly controlled to move axially along the outer diameter of a bottom end portion of the inner housing so that a rotatable control ring moves about a guide pin to hold a neutral, straight, or bent position of the piston assembly corresponding to an amount of compression of the compression spring. The tilt housing partially disposed within the outer housing includes a bolt plate pin channel configured to receive a bolt plate pin of the piston assembly that travels to tilt the tilt housing by a tilting mechanism that connects the tilt housing to the outer housing and position the tilt housing in a neutral, straight, or bent position corresponding to the neutral, straight, or bent position of the piston assembly. The downhole adjustable drilling inclination tool may be configured to receive a drive shaft within an innermost diameter of the tool.

According to one aspect of one or more embodiments of the present invention, a method of adjusting a downhole adjustable drilling inclination tool includes providing a fluid to a bottomhole assembly that includes the downhole adjustable drilling inclination tool disposed in a wellbore, and controlling the pressure of the fluid provided to the bottomhole assembly to achieve a desired fluid pressure difference between the fluid in the downhole adjustable drilling inclination tool and return fluid in an annulus between an outermost diameter of the downhole adjustable drilling inclination tool and the wellbore. The fluid pressure difference fluidly controls the position of a piston assembly of the downhole adjustable drilling inclination tool between a neutral, straight, or bent position and a corresponding neutral, straight, or bent position of a tilt housing of the downhole adjustable drilling inclination tool.

Other aspects of the present invention will be apparent from the following description and claims.

BRIEF DESCRIPTION OF THE DRAWINGS

FIGS. 10A, 10B, 10C, 10D, and 10E show a top distal end view, side view, bottom distal end view, cross-sectional side view, and perspective view respectively of an inner housing of a downhole adjustable drilling inclination tool in accordance with one or more embodiments of the present invention.

FIGS. 17A, 17B, 17C, 17D, 17E, and 17F show a right side view, front side view, left side view, top side view, front side perspective view, and rear side perspective view respectively of a bolt plate pin of a downhole adjustable drilling inclination tool in accordance with one or more embodiments of the present invention.

DETAILED DESCRIPTION OF THE INVENTION

Figure 1:
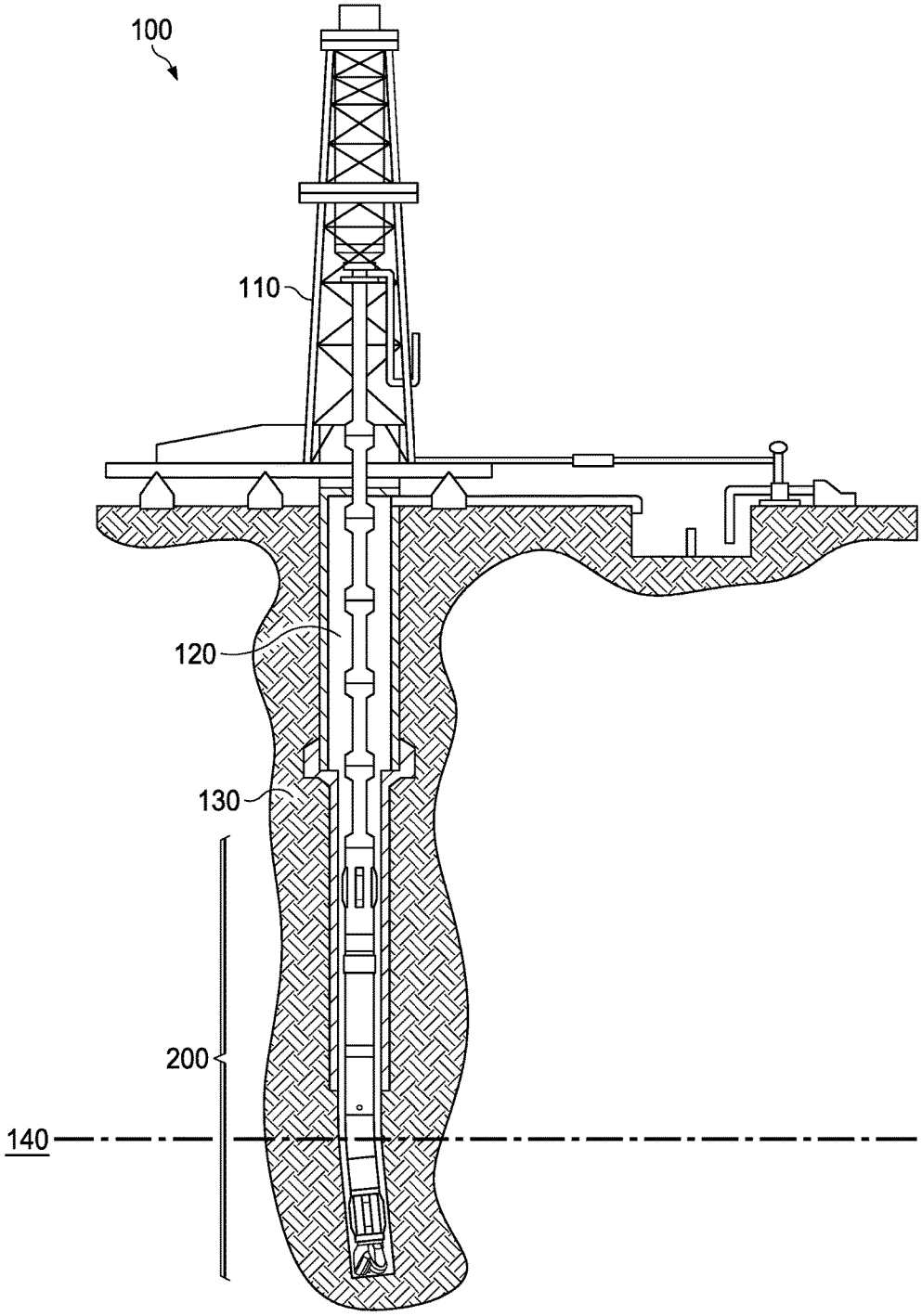
FIG. 1 shows a partial cross-sectional view of a drilling operation using a bottomhole assembly that includes a downhole drilling inclination tool in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a detailed understanding of the present invention. In other instances, well-known features to one of ordinary skill in the art are not described to avoid obscuring the description of the present invention.

There are three types of conventional directional drilling systems in common use today: fixed-bend, adjustable-bend, and rotary-steerable. The conventional directional drilling systems may be distinguished from one another in their respective manner of operation, their unique combination of advantages and disadvantages, and their technical and economic feasibility for a given drilling project.

Fixed-bend systems are the simplest of the conventional directional drilling systems and use a bent subassembly, also referred to as a bent sub, to provide a small fixed deviation to the face of the drill bit engaging a formation. In fixed-bend systems, rotation is provided to the drill bit by a downhole drilling motor, also referred to as a mud motor, typically of the Moineau type. Drilling fluid is pumped through the mud motor to convert hydraulic power into mechanical power and provide concentric rotation to the drill bit. During drilling operations, the bent sub changes the inclination angle of the drill bit causing the wellbore direction to deviate in a process sometimes referred to as slide drilling. The location of the bent sub in the bottomhole assembly may vary based on an application or design. In certain applications, instead of a bent sub that is typically attached to the top end of a mud motor, a bent housing of the mud motor itself, or a subsystem thereof, may be used. Bent housings are considered more effective than bent subs because of the shorter distance from tilt to bit, which typically reduces the radius of the well trajectory as compared to bent subs.

During drilling operations, a combination of conventional straight drilling operations and directional drilling operations may be used to achieve a given well plan. During straight drilling operations, rotation is typically provided from the surface. When the well plan calls for a deviation, or kickoff, in the well trajectory, the drill string is tripped, a bent sub or housing is installed on the surface as part of the bottomhole assembly (and may include a downhole mud motor if rotation was previously provided from the surface), and the drill string is reinserted downhole. Once tripped in, rotation is provided by the downhole mud motor to the drill bit. Depending on the well plan, more than one bent sub or housing may be required to achieve the desired inclination angle. Each time a bent sub or housing is changed, the entire drill string must be tripped. Once the desired deviation in the well trajectory has been achieved, the drill string is typically tripped again to remove the bent sub or housing and the downhole mud motor from the bottomhole assembly. The drill string is then tripped in again and straight drilling operations may be resumed with rotation provided by the surface.

While fixed-bend systems are simple and comparatively inexpensive, there are a number of issues with their use. Because the inclination angle provided by a given bent sub or housing is small and fixed, a plurality of bent subs or housings with different inclination angles may be required to achieve the target inclination angle for a desired well trajectory. While a given bent sub or housing is relatively inexpensive, a typical directional drilling operation requires a number of bent subs or housings at significant expense. More importantly, each time a bent sub or housing is changed, the drill string is tripped at substantial expense. Tripping the drill string requires removing the entire drill string from the wellbore, changing out the bent sub or housing on the surface, and reinserting the entire drill string back into the wellbore. In addition to the costs in time, labor, and materials associated with such operations, including the associated unproductive down time, there are safety and environmental hazards associated with tripping the drill string. From the wellbore perspective, the use of a plurality of bent subs or housings results in undesirable stair-stepping in the profile that reduces the quality and the integrity of the hole. When drilling straight with bent subs or housings, rotation is typically provided from the surface, which causes the bent sub or housing to rotate the bit eccentrically which increases the diameter of the borehole. In addition, the use of a plurality of bent subs or housings results in a large arcing radius in the well trajectory.

Adjustable-bend systems are similar to fixed-bend systems, but allow for some manner of adjustment to the inclination angle of the face of the drill bit engaging a formation. Adjustable-bend systems include surface-adjustable systems that allow for adjustment of the inclination angle of an adjustable bent sub or housing on the surface prior to tripping into the wellbore and downhole-adjustable systems that allow for adjustment of the inclination angle of the adjustable bent sub or housing downhole.

In a surface-adjustable system, the adjustable bent sub or housing is not fixed such that the inclination angle may be adjusted to a desired inclination angle within mechanical constraints and locked into place on the surface prior to tripping into the wellbore. While surface-adjustable systems reduce the number of bent subs or housings required to achieve a desired inclination angle, the drill string must still be tripped each time a change to the inclination angle is desired. As such, surface-adjustable systems represent a minor cost savings over fixed-bend systems because fewer bent subs or housings are required, but the dominant and substantial cost of tripping the drill string, and the associated unproductive down time, remain an issue with surface-adjustable systems.

Downhole-adjustable systems attempt to alleviate the requirement of having to trip the drill string every time a change to the inclination angle is desired. There are a variety of types and kinds of downhole-adjustable systems in the prior art. However, conventional downhole-adjustable systems are complex, prone to failure, expensive, difficult to operate, and cannot accommodate large diameter drive shafts used in modern high-torque mud motors. Conventional downhole-adjustable systems use actuators, splines, or sliding rings, or bend the drive shaft itself, to create the deviation in the inclination angle. Because of their complexity, these mechanisms are prone to failure and are difficult to operate. However, even in operative use, these conventional downhole-adjustable systems, because of their design, cannot accommodate the larger diameter drive shafts used in modern high-torque mud motors. As such, there are no commercially viable downhole-adjustable systems for high-torque mud motors that use large diameter drive shafts.

Rotary-steerable systems are the most complicated of the conventional directional drilling systems and use a programmable rotary-steerable tool, advanced real-time data acquisition, and telemetry to more accurately control the well trajectory while drilling. A measurement-while-drilling system monitors the direction, inclination, and orientation of the tool in real time and communicates data to the surface via telemetry. In autonomous mode, the rotary-steerable tool uses real-time data acquired while drilling to maintain the tool on the desired well path, making adjustments as needed to the inclination angle without having to stop drilling. However, operators can send commands to the rotary-steerable tool while it is downhole should the need arise. In practice, rotary-steerable systems provide a number of advantages including tighter control on the well trajectory, continuous rotation of the drill string, improved rate of penetration, improved weight on bit, and improved wellbore quality.

While rotary-steerable systems provide a number of advantages, there are a number of issues with their use. Rotary-steerable tools are extremely expensive and a number of such tools are typically required for a given drilling project. Typically, at least two rotary-steerable tools (one operative and one backup) are required for each diameter to be drilled. Because of the telescoping effect, a typical drilling operation requires the drilling of a number of different diameters. Consequently, a number of expensive rotary-steerable tools are needed. In addition, because of the electronics, rotary-steerable tools are vulnerable and prone to failure. If the tool gets stuck and the drill string is popped, the tool or its electronics may be damaged. Worse still, the rotary-steerable tool may be lost in the hole. If the drill string breaks, you have to fish the rotary-steerable tool out of the wellbore before continuing with drilling operations. However, sometimes, fishing operations are not successful and the rotary-steerable tool cannot be recovered. In these circumstances, the wellbore has to be plugged and new drilling operations are required to reach the target reserves at substantial additional expense.

Drilling operations expenditures are typically constrained by their anticipated return on investment and the economic climate. As such, each drilling project has its own unique constraints that dictate what type of directional drilling system may be used. For cost constrained directional drilling projects, comparatively inexpensive fixed-bend systems are typically used. While downhole-adjustable systems are desirable for reducing the cost associated with tripping the drill string, they are complex, expensive, and there are no commercially viable downhole-adjustable systems for larger diameter drive shafts used in modern high-torque mud motors. For large scale directional drilling projects, expensive rotary steerable systems are typically used, but such systems are cost prohibitive for most drilling projects.

Accordingly, in one or more embodiments of the present invention, a downhole adjustable drilling inclination tool addresses a long felt gap between the two predominant technologies used in directional drilling and provides a number of technical and economic benefits. Advantageously, in one or more embodiments of the present invention, the downhole adjustable drilling inclination tool is simple, inexpensive, and is more reliable than existing fixed-bend, downhole-adjustable, and rotary steerable systems. In addition, the downhole adjustable drilling inclination tool does not bend the drive shaft and can accommodate larger diameter drive shafts used in modern high-torque mud motors. As such, the downhole adjustable drilling inclination tool may be used across the spectrum of drilling applications.

FIG. 1 shows a partial cross-sectional view of a drilling operation 100 using a bottomhole assembly 200 that includes a downhole drilling inclination tool (not independently illustrated) in accordance with one or more embodiments of the present invention. During drilling operations, a drilling rig 110 may be used to drill a wellbore 120 according to a planned well trajectory to recover targeted geothermal energy or oil and gas reserves (not independently illustrated) disposed below the Earth's 130 surface. While the figure depicts a type of land-based rig, other types of land-based rigs, as well as water-based rigs, may be used in accordance with one or more embodiments of the present invention. Drilling operations typically commence with straight drilling operations that drill a substantially vertical, or straight, wellbore 120. A substantially vertical, or straight, wellbore is substantially perpendicular to the planar surface of the Earth. However, in many instances, the planned well trajectory deviates from vertical and requires a more complicated well trajectory. Initially, the downhole adjustable drilling inclination tool may be used in a straight position that allows for straight drilling operations. When a kickoff 140 is desired, the downhole adjustable drilling inclination tool may be fluidly controlled to a bent position that allows for directional drilling operations. When switching to the bent position, the downhole adjustable drilling inclination tool adjusts the inclination angle of the drill bit (not independently illustrated) engaging the formation. During drilling operations, the downhole adjustable drilling inclination tool may be fluidly controlled to switch between the straight position and the bent position as needed to achieve the planned well trajectory. Advantageously, in one or more embodiments of the present invention, the downhole adjustable drilling inclination tool allows for switching between straight drilling and directional drilling without tripping the drill string.

Figure 2A:
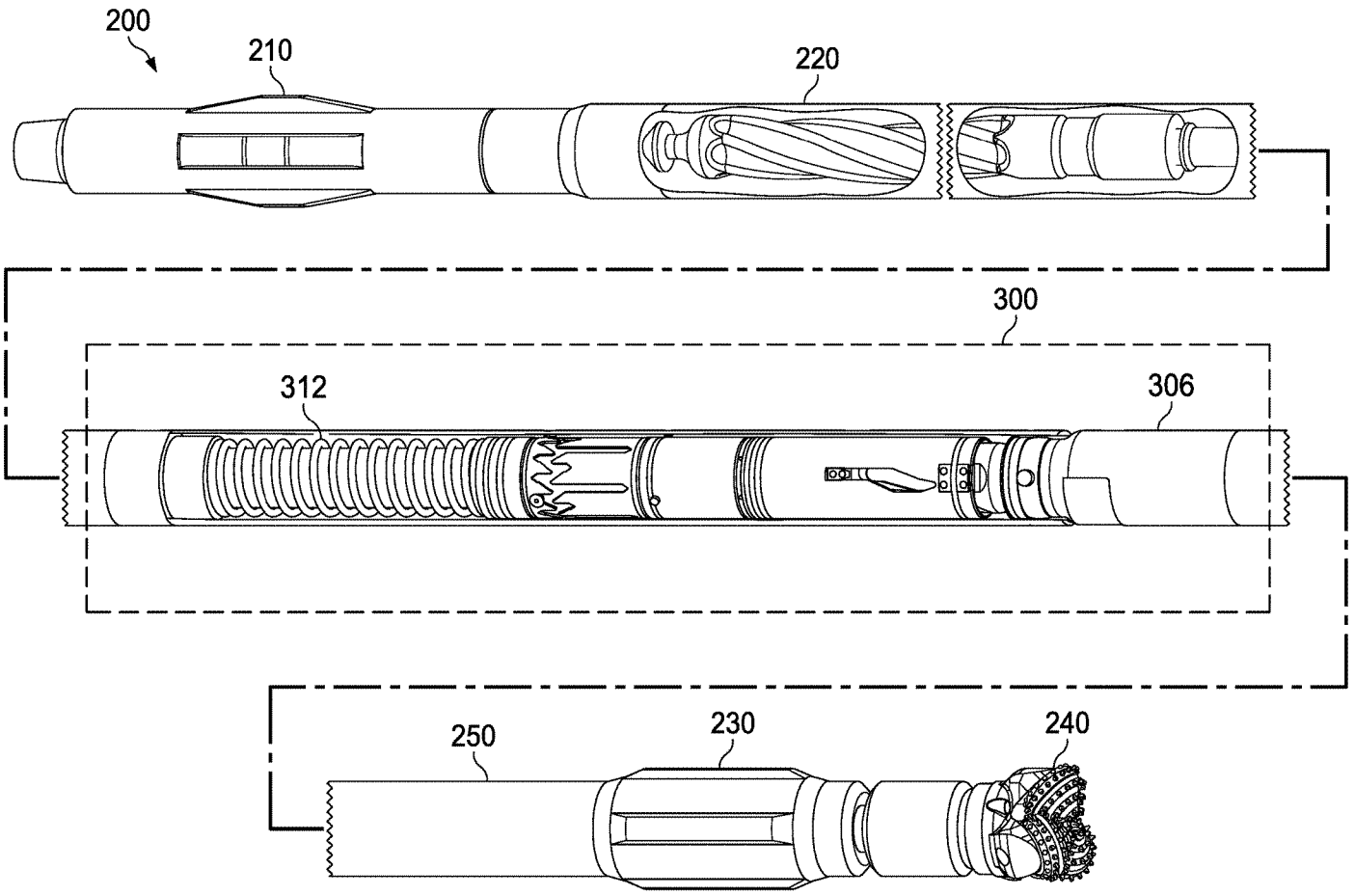
FIGS. 2A, 2B, and 2C show a side view of a bottomhole assembly with a downhole adjustable drilling inclination tool with a tilt housing in a straight, neutral, and bent position respectively in accordance with one or more embodiments of the present invention.

FIG. 2A shows a side view of a bottomhole assembly 200 with a downhole adjustable drilling inclination tool 300 with a tilt housing 306 in a neutral position in accordance with one or more embodiments of the present invention. Generally, a bottomhole assembly 200 is the lowest portion of the drill string that provides force to the drill bit. In the figure, the left side represents the top distal portion of the bottomhole assembly 200 that is closest to the surface during drilling operations and the right side represents the bottom distal portion of the bottomhole assembly 200 that is closest to the formation face being drilled. This convention is maintained throughout the figures. Bottomhole assembly 200 may include a stabilizer 210, a power section 220 (mud motor-type depicted), a downhole drilling inclination tool 300 with a drive shaft assembly (not independently illustrated) disposed there through, a bearing assembly 250, a stabilizer 230, and a drill bit 240. While definitions of what components constitutes a mud motor vary, the power section 220 typically provides eccentric rotation and the drive shaft assembly converts the eccentric rotation to concentric rotation that is ultimately used to rotate the drill bit 240. One of ordinary skill in the art will recognize that the configuration of bottomhole assembly 200, including the type, kind, number, and orientation of components, may vary based on an application or design in accordance with one or more embodiments of the present invention. In addition, one of ordinary skill in the art will recognize that the downhole adjustable drilling inclination tool 300 may be used in any other bottomhole assembly 200 configuration that uses a drive shaft assembly or motor that is, for example, located in the bearing assembly.

In the absence of substantial differential pressure between an interior of the downhole adjustable drilling inclination tool 300 and an annulus between an outer housing (not shown) of the downhole adjustable drilling inclination tool 300 and the wellbore (not shown), compression spring 312 returns to its preloaded compression and a piston assembly (not independently illustrated) moves axially toward a tilt housing 306 of the downhole adjustable drilling inclination tool 300 (in a direction corresponding to a bottom of the drill string), positioning the tilt housing 306 more or less parallel to the outer housing of the downhole adjustable drilling inclination tool 300. The neutral position of the downhole adjustable drilling inclination tool 300 may be used, for example, when tripping the bottomhole assembly 200 into or out of a wellbore and serves as the in between state when switching between a straight position and a bent position.

Figure 2B:
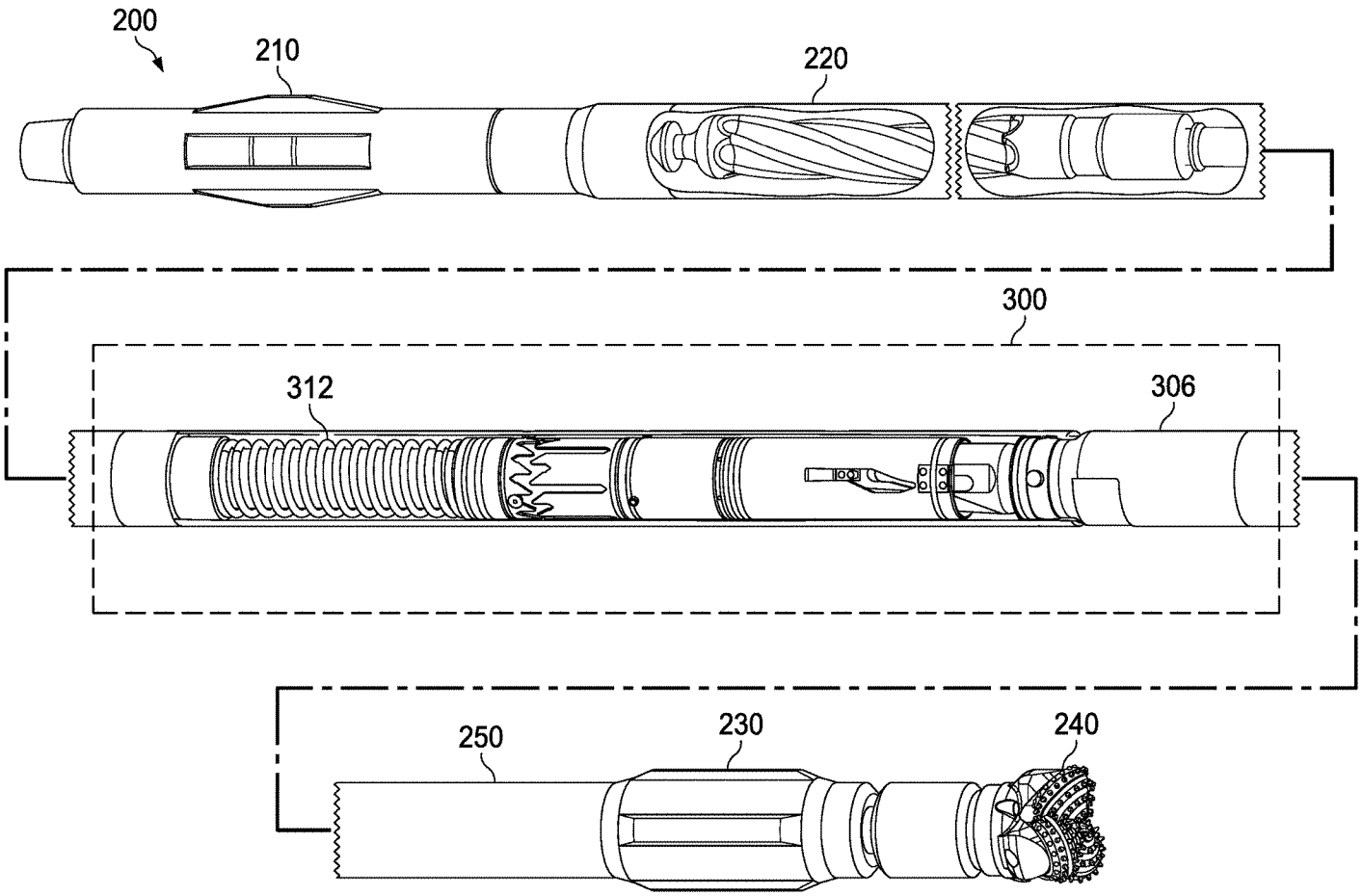

Continuing, FIG. 2B shows a side view of the bottomhole assembly 200 with the downhole adjustable drilling inclination tool 300 with the tilt housing 306 in a straight position in accordance with one or more embodiments of the present invention. Starting from the neutral position, when there is an application of sufficient differential pressure (at or above an activation threshold) between the interior of the downhole adjustable drilling inclination tool 300 and the annulus (not shown) between the outer housing (not shown) of the downhole adjustable drilling inclination tool 300 and the wellbore (not shown), compression spring 312 compresses and the piston assembly moves away from the tilt housing 306 (in a direction corresponding to a top of the drill string), positioning the tilt housing 306 in the straight position. In the straight position, downhole adjustable drilling inclination tool 300 may be suitable for straight drilling operations.

Figure 2C:
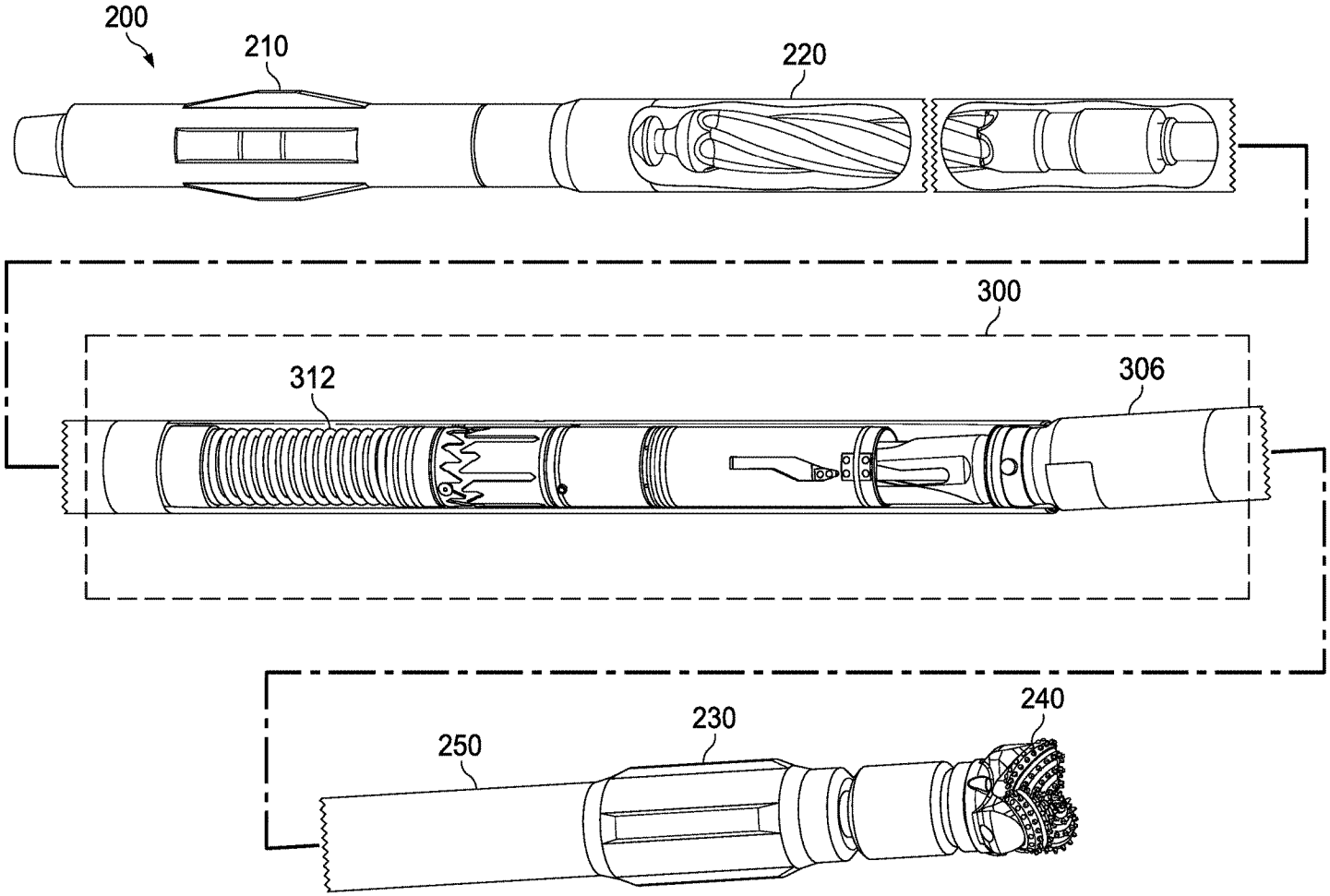

Continuing, FIG. 2C shows a side view of the bottomhole assembly 200 with the downhole adjustable drilling inclination tool 300 with the tilt housing 306 in a bent position in accordance with one or more embodiments of the present invention. While downhole adjustable drilling inclination tool 300 is in the straight position and the differential pressure between the interior of the downhole adjustable drilling inclination tool 300 and the annulus (not shown) between the outer housing (not shown) of the downhole drilling inclination tool 300 and the wellbore (not shown) falls to or below a deactivation threshold, the tool 300 returns to the neutral position. Upon the next application of sufficient differential pressure (at or above an activation threshold) between the interior of the downhole adjustable drilling inclination tool 300 and the annulus (not shown) between the outer housing (not shown) of the downhole adjustable drilling inclination tool 300 and the wellbore (not shown), compression spring 312 compresses and the piston assembly moves away from the tilt housing 306 (in a direction corresponding to a top of the drill string), positioning the tilt housing 306 in the bent position. When the tilt housing 306 is in the bent position, a bottom drive shaft coupling (not independently illustrated) is slightly deviated from the longitudinal centerline of the outer housing (not shown), such that a drive shaft (not shown) disposed within the downhole adjustable drilling inclination tool 300 has an inclination angle with respect to the longitudinal centerline of the outer housing of the tool 300. As such, the face of the drill bit 240 facing the formation is angled allowing for directional drilling operations.

Figure 3A:
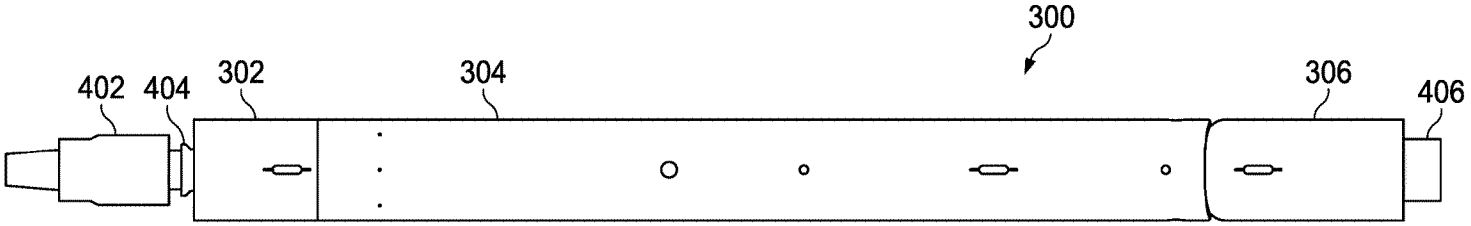
FIGS. 3A, 3B, and 3C show a top side view, side view, and bottom side view respectively of a downhole adjustable drilling inclination tool with a tilt housing in a straight or neutral position in accordance with one or more embodiments of the present invention.

FIG. 3A shows a top side view of a downhole adjustable drilling inclination tool 300 with a tilt housing 306 in a straight or neutral position in accordance with one or more embodiments of the present invention. Downhole adjustable drilling inclination tool 300 includes an inner housing 302, an outer housing 304, and a tilt housing 306. A portion of the inner housing 302, a compression spring (not shown), a piston assembly (not shown), and a portion of the tilt housing 306 may be disposed within a hollow inner diameter of the outer housing 304. A drive shaft assembly 402, 404, and 406 may be disposed within a hollow innermost diameter of the downhole adjustable drilling inclination tool 300. A top drive shaft coupling 402 may be exposed by a top distal end of the inner housing 302. A bottom drive shaft coupling 406 may be exposed by a bottom distal end of the tilt housing 306. The top drive shaft coupling 402 may couple a top distal end of the drive shaft 404 to a power section (not shown) and the bottom drive shaft coupling 406 may couple a bottom distal end of the drive shaft 404 to a bearing assembly (not shown) or a combination bearing and drill bit assembly (not shown).

Figure 3B:
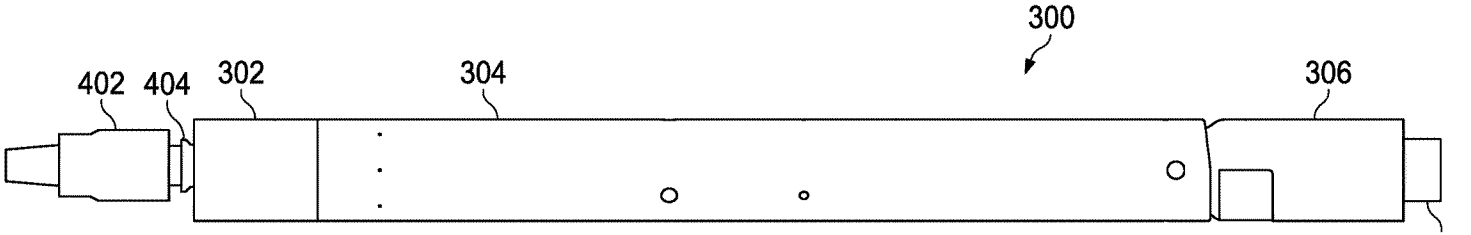
Figure 3C:
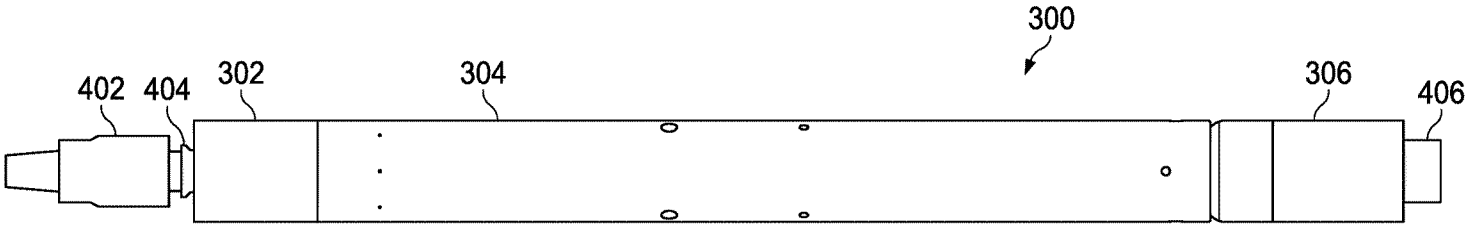

The drive shaft 404 orientation within the hollow innermost diameter of the downhole adjustable drilling inclination tool 300 may be determined by an orientation of the bottom drive shaft coupling 406. In the figure, the downhole adjustable drilling inclination tool 300 is in the straight or neutral position. As such, the tilt housing 306 is parallel to the outer housing 304 and the drive shaft 404 is substantially parallel to the longitudinal centerline of the outer housing 304 of the tool 300. Continuing, FIG. 3B shows a side view of the downhole adjustable drilling inclination tool 300 with the tilt housing 306 a straight or neutral position in accordance with one or more embodiments of the present invention. Continuing, FIG. 3C shows a bottom side view of the downhole adjustable drilling inclination tool 300 with the tilt housing 306 in a straight or neutral position in accordance with one or more embodiments of the present invention.

Figure 4A:
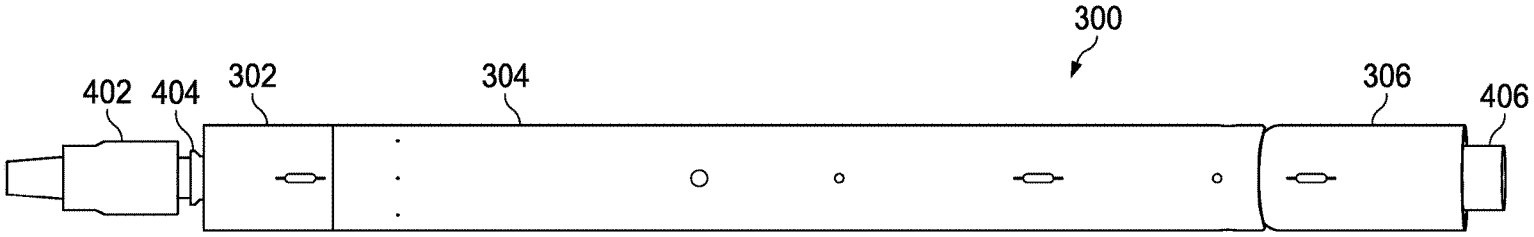
FIGS. 4A, 4B, and 4C show a top side view, side view, and bottom side view respectively of a downhole adjustable drilling inclination tool with a tilt housing in a bent position in accordance with one or more embodiments of the present invention.
Figure 4B:
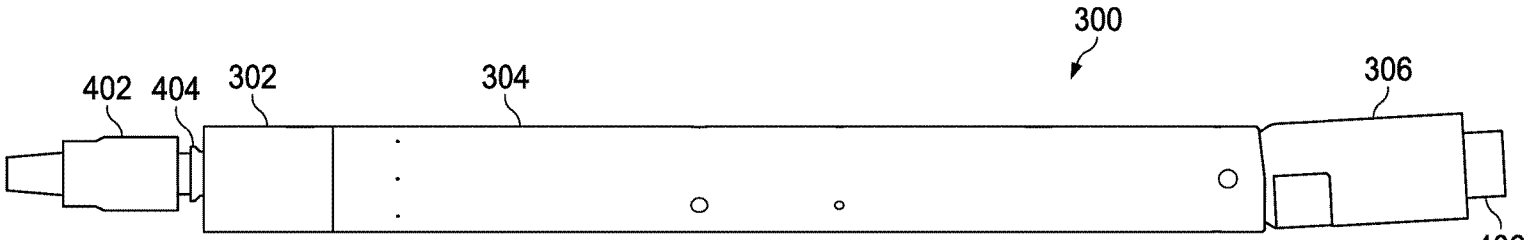
Figure 4C:
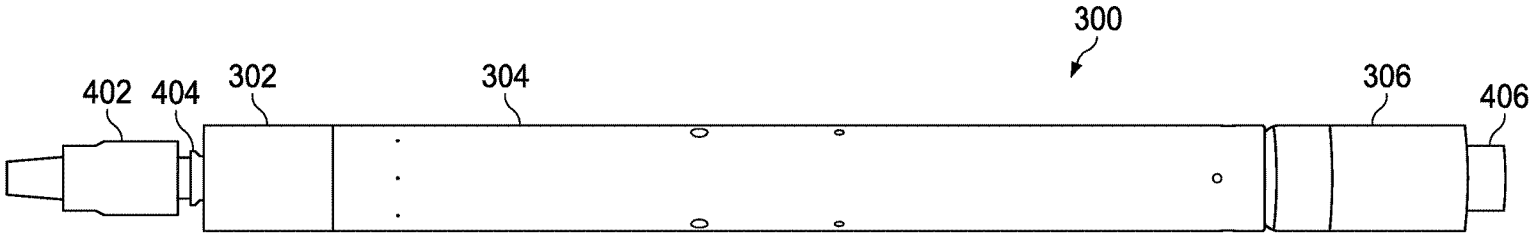

FIG. 4A shows a top side view of a downhole adjustable drilling inclination tool 300 with a tilt housing 306 in a bent position in accordance with one or more embodiments of the present invention. Continuing, FIG. 4B shows a side view of the downhole adjustable drilling inclination tool 300 with the tilt housing 306 in the bent position in accordance with one or more embodiments of the present invention. In the bent position, the tilt housing 306 is tilted such that the bottom drive shaft coupling 406 is tilted and the drive shaft 404 no longer rotates about or around the longitudinal centerline of the outer housing 304. The drive shaft 404 is now oriented at an inclination angle, or deviation, from the longitudinal centerline of the outer housing 304 of the tool 300. Continuing, FIG. 4C shows a bottom side view of the downhole adjustable drilling inclination tool 300 with the tilt housing 306 in the bent position in accordance with one or more embodiments of the present invention.

Figure 5A:
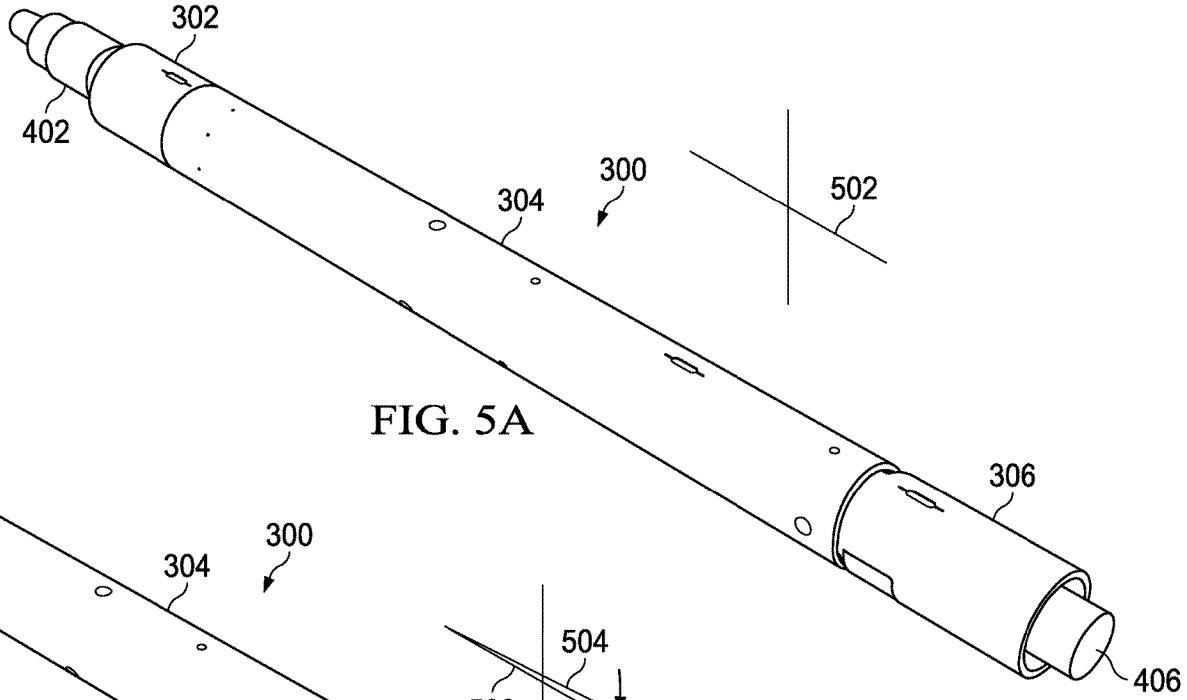
FIGS. 5A and 5B show a perspective view of a downhole adjustable drilling inclination tool with a tilt housing in a straight or neutral position and a bent position respectively in accordance with one or more embodiments of the present invention.
Figure 5B:
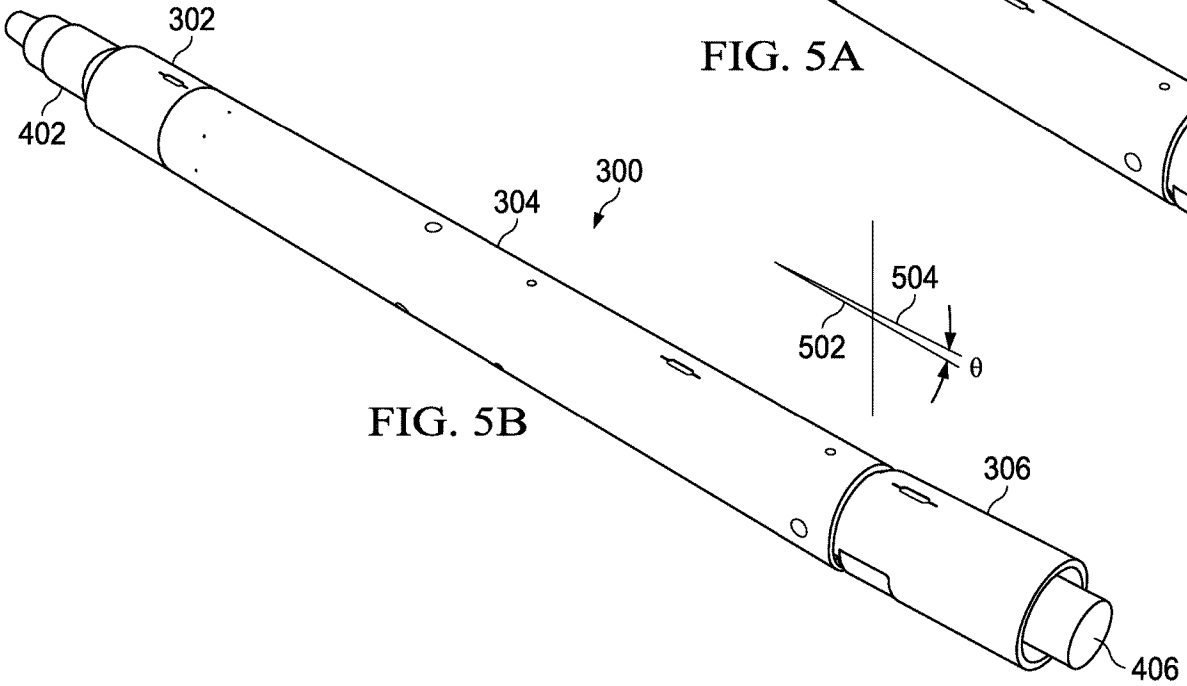

FIG. 5A shows a perspective view of a downhole adjustable drilling inclination tool 300 with a tilt housing 306 in a straight or neutral position in accordance with one or more embodiments of the present invention. In the straight or neutral position, the tilt housing 306 may be parallel to the outer housing 304, such that the orientation of the top drive shaft coupling 402, drive shaft (not shown), and the bottom drive shaft coupling 406 is substantially parallel to the longitudinal centerline 502 of the outer housing 304. Continuing, FIG. 5B shows a perspective view of the downhole adjustable drilling inclination tool 300 with the tilt housing 306 in a bent position in accordance with one or more embodiments of the present invention. In the bent position, the tilt housing 306 is bent, tilted, or angled at an inclination angle 504 from the longitudinal centerline 502 of the outer housing 304, such that the orientation of the top drive shaft coupling 402, drive shaft (not shown), and the bottom drive shaft coupling 406 is at the inclination angle 504 from the longitudinal centerline 502 of the outer housing 304 within the downhole adjustable drilling inclination tool 300. As shown in FIGS. 5A and 5B, an orientation of the bottom drive shaft coupling 406 may be determined by the neutral, straight, or bent position of the tilt housing 306.

In certain embodiments, the bent position provides an inclination angle 504 in a range between 0 degrees and 3 degrees inclusive. One of ordinary skill in the art will recognize that the range of inclination angle 504 may vary based on an application or design in accordance with one or more embodiments of the present invention. In addition, one of ordinary skill in the art will recognize that as the downhole adjustable drilling inclination tool 300 scales in size, the range of inclination angle 504 may vary in accordance with one or more embodiments of the present invention.

Figure 6A:
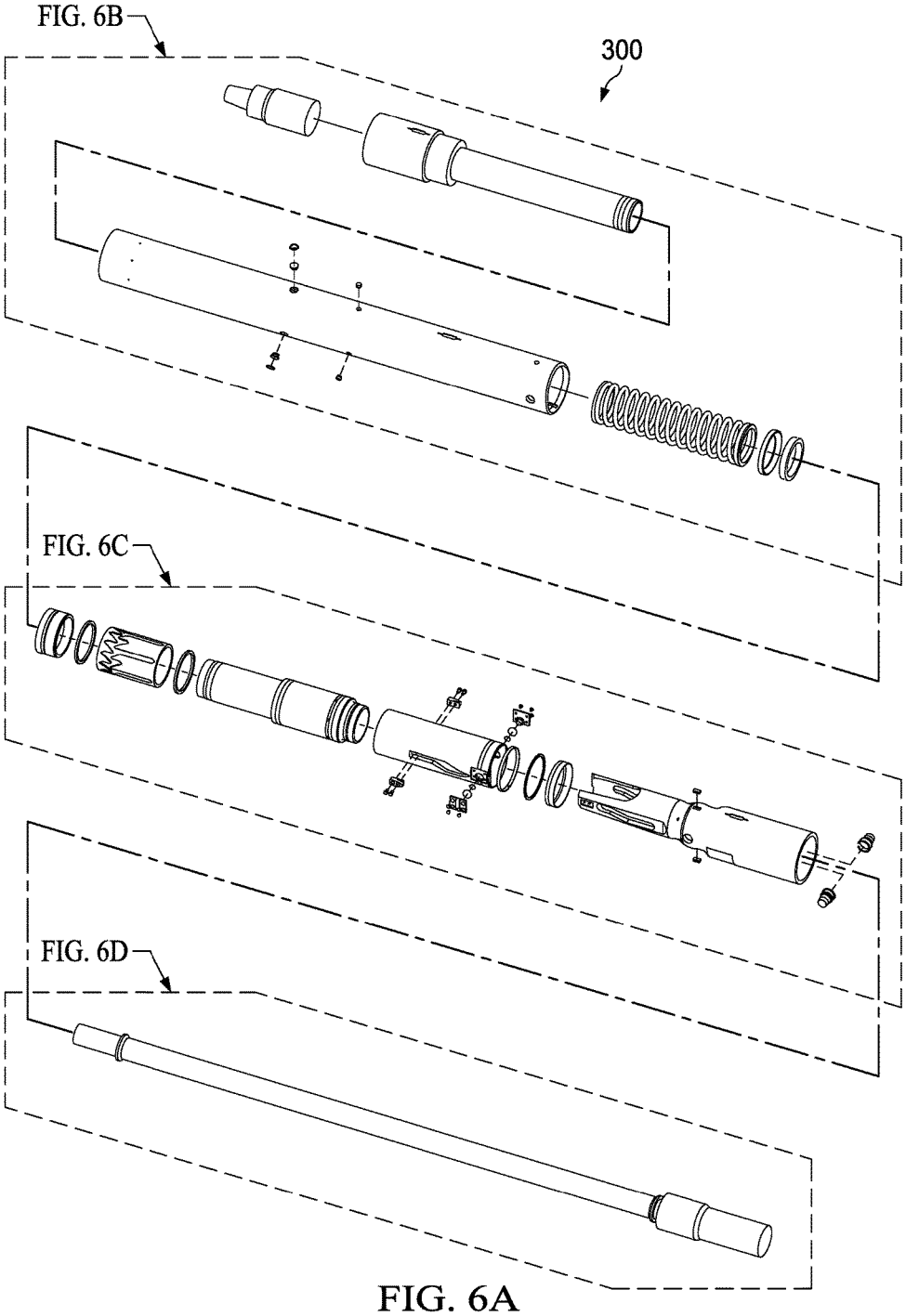
FIGS. 6A, 6B, 6C, 6D, 6E, 6F and 6G show an exploded perspective view, first detail portion, second detail portion, third detail portion, exploded perspective view partially assembled, fourth detail portion, and assembled perspective view respectively of a downhole adjustable drilling inclination tool in accordance with one or more embodiments of the present invention.

FIG. 6A shows an exploded perspective view of a downhole adjustable drilling inclination tool 300 in accordance with one or more embodiments of the present invention. In certain embodiments, a piston assembly (not independently illustrated) may be assembled first as part of the tool 300 assembly processes. A tilt housing (not independently illustrated) may then be assembled and connected to the piston assembly. A compression spring (not independently illustrated) may then be disposed about an outer diameter of a bottom end portion of an inner housing (not independent illustrated), which is then inserted into the top distal end of the outer housing (not independently illustrated). The inner housing may connect to the outer housing by threading disposed on an intermediate portion (not independently illustrated). The piston assembly and tilt housing may then be inserted into the bottom distal end of the outer housing. A top drive shaft coupling (not independently illustrated) may then be inserted into a top distal end of the inner housing, a drive shaft (not independently illustrated) may be inserted through a bottom distal end of the downhole adjustable drilling inclination tool 300, through an innermost hollow diameter, and a bottom drive shaft coupling (not independently illustrated) may then be inserted into the bottom distal end of the tilt housing such that the drive shaft assembly may be substantially within an innermost diameter of the downhole adjustable drilling inclination tool 300. One of ordinary skill in the art will recognize that the assembly processes for the downhole adjustable drilling inclination tool 300 described above are merely illustrative and may vary in accordance with one or more embodiments of the present invention.

Figure 6B:
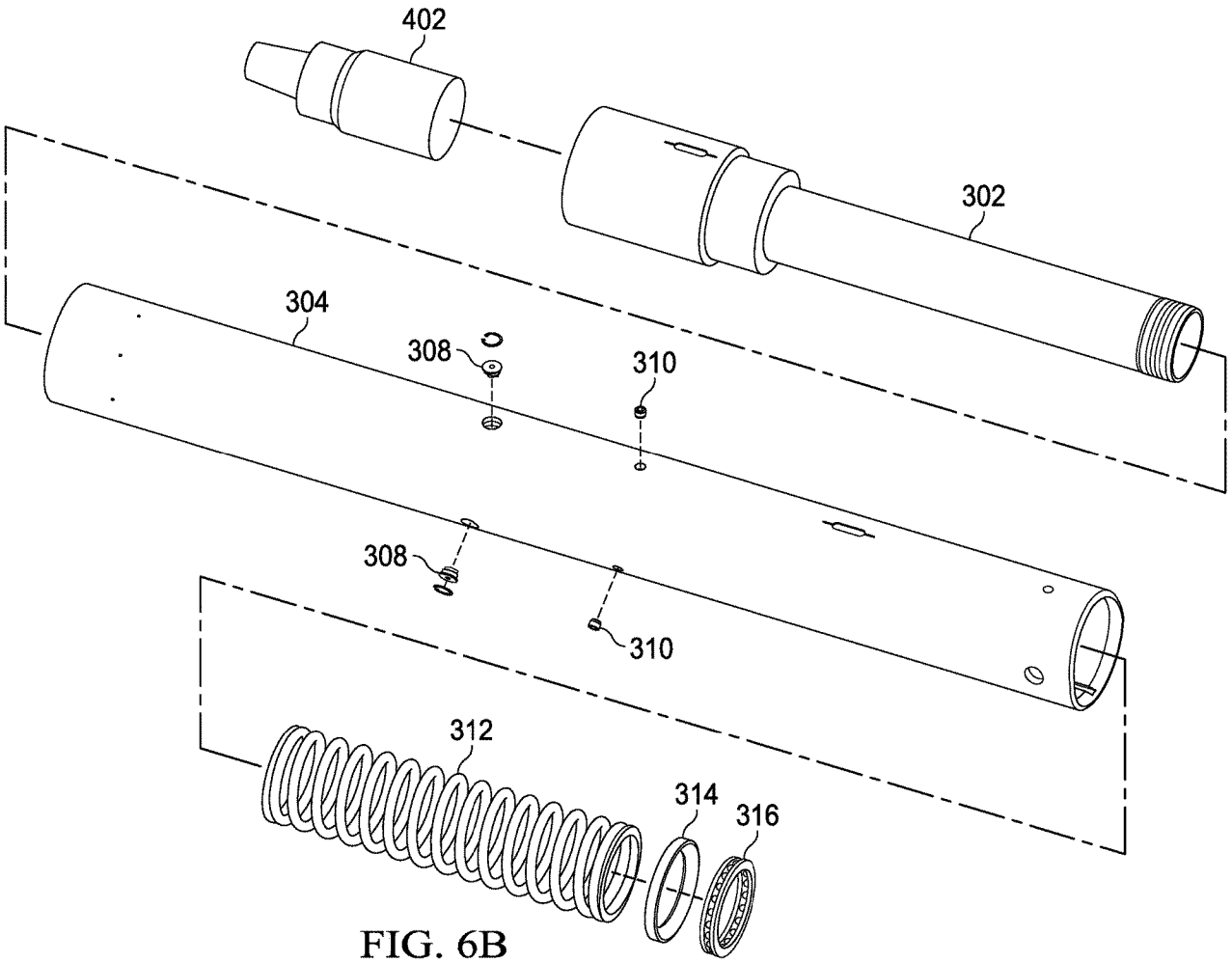

Continuing, FIG. 6B shows a first detail portion of the exploded perspective view of the downhole adjustable drilling inclination tool 300 shown in FIG. 6A in accordance with one or more embodiments of the present invention. In the figure, top drive shaft coupling 402, inner housing 302, outer housing 304, a plurality of guide pins 308, a plurality of optional nozzles 310 that may be used to plug one or more pressure bleed holes, compression spring 312, slide ring 314, and axial thrust ball bearing 316 are shown. Compression spring 312 may be disposed about an outer diameter of a bottom end portion of the inner housing 302, which is then disposed within the outer housing 304. Slide ring 314 provides a space between compression spring 312 and axial thrust ball bearing 316. Axial thrust ball bearing 316 facilitates rotation of the compression spring 312 and reduces friction.

Figure 6C:
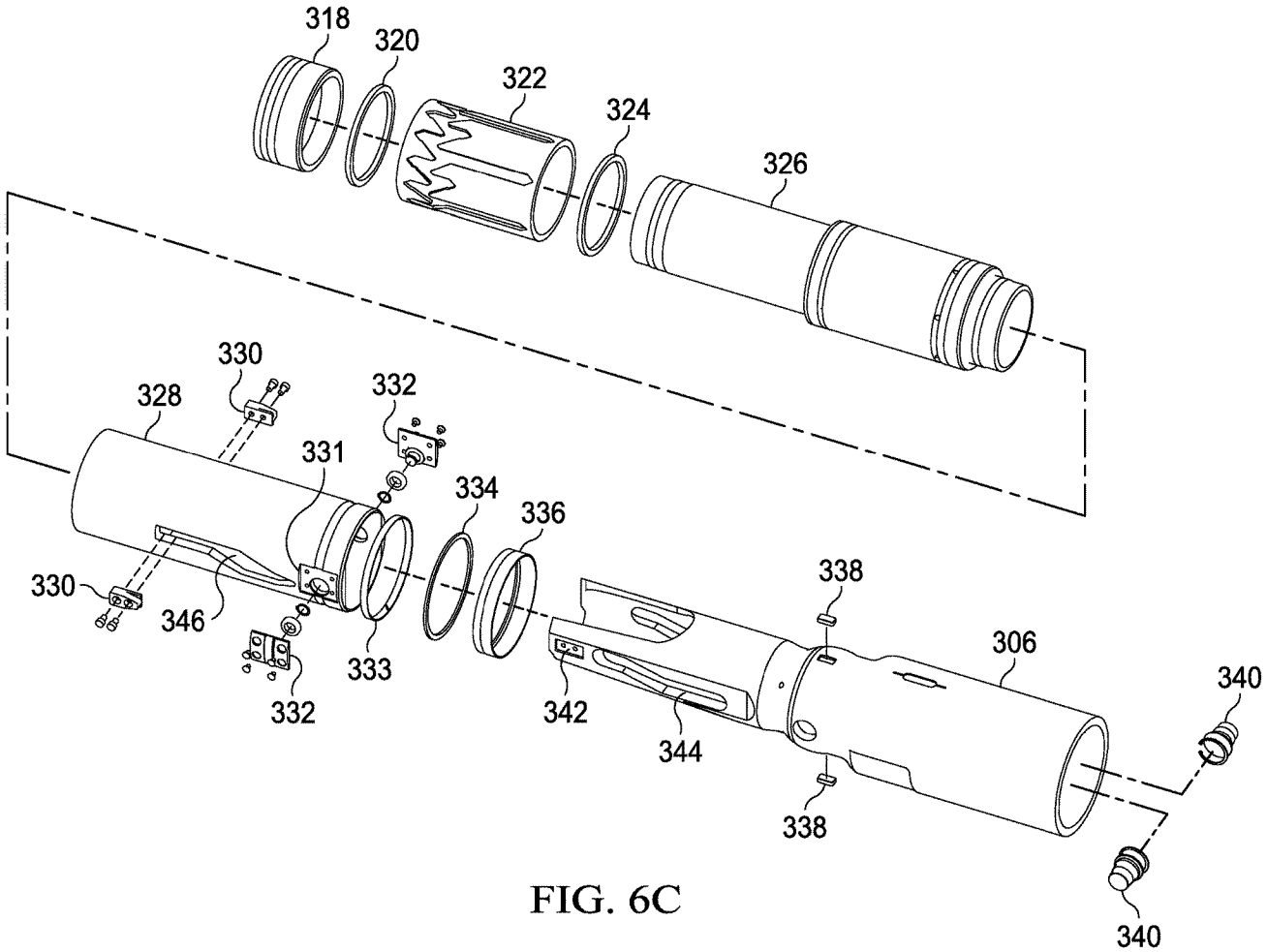

Continuing, FIG. 6C shows a second detail portion of the exploded perspective view of the downhole adjustable drilling inclination tool 300 shown in FIG. 6A in accordance with one or more embodiments of the present invention. In the figure, a lock ring 318 is shown that connects to a first piston member 326. A friction ring 320 reduces friction between the lock ring 318 and the rotatable control ring 322, allowing the control ring 322 to rotate easier. Another friction ring 324 reduces friction between the rotatable control ring 322 and first piston member 326, also allowing the control ring 322 to rotate easier. First piston member 326 connects to second piston member 328. Tilt housing 306 may be inserted through a locking seal ring 336, seal ring 334, and friction ring 333 into a bottom distal end of second piston member 328. A plurality of lock cams 330 may be secured through a plurality of lock cam channels 346 (only one side is shown) of the second piston member 328 and connected to a plurality of lock cam receivers 342 (only one side shown) of the tilt housing 306. A plurality of bolt plate pins 332 may be secured through a plurality of bolt plate pin receivers 331 (only one side shown) of the second piston member 328 such that the bolt plate pins 332 can travel in the bolt plate pin channels 344 (only one side shown) of the tilt housing 306. Friction ring 333 may be disposed over the bolt plate pins 332 and locking seal ring 336 may be secured to the second piston member 328. A plurality of removable torque keys 338 may be inserted into the tilt housing 306 to reduce stress on the fulcrum pins 340 during operation (for fulcrum pin-type tilting mechanism embodiments). In fulcrum pin-type tilting mechanism embodiments, once the piston assembly (which may include, for example, 318, 320, 322, 324, 326, 328, 332, 333, 334, and 336) is connected to the tilt housing 306 and inserted into the outer housing (not shown), a plurality of fulcrum pins 340 (only one side shown) may be secured through an interior of the tilt housing 306 into the outer housing, allowing the tilt housing to tilt on the fulcrum pins 340.

Figure 6D:
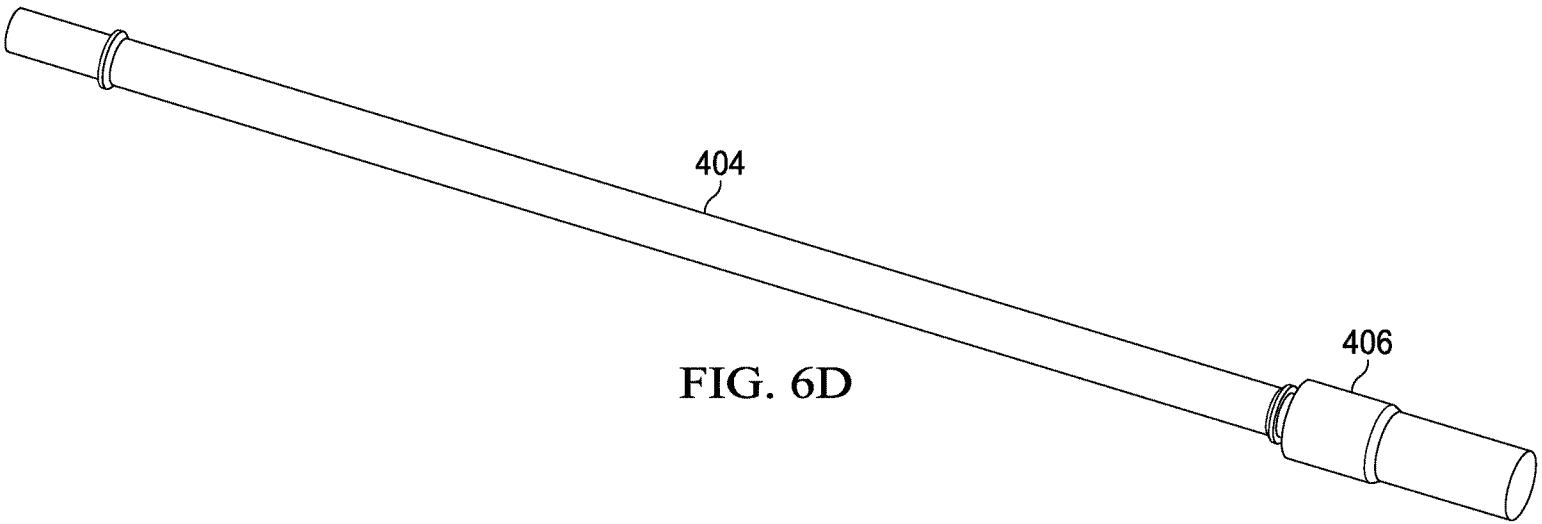

Continuing, FIG. 6D shows a third detail portion of the exploded perspective view of the downhole adjustable drilling inclination tool 300 shown in FIG. 6A in accordance with one or more embodiments of the present invention. The drive shaft 404 may be passed through the bottom distal end of the tilt housing (not shown) and the downhole adjustable drilling inclination tool (not shown) itself and then the bottom drive shaft coupling 406 may be connected to the drive shaft 404. Alternatively, a bottom drive shaft coupling 406 may be connected to drive shaft 404 in preparation of passing the drive shaft 404 through the bottom distal end of the tilt housing (not shown) and the downhole adjustable drilling inclination tool (not shown) itself as one of the last assembly steps.

Figure 6E:
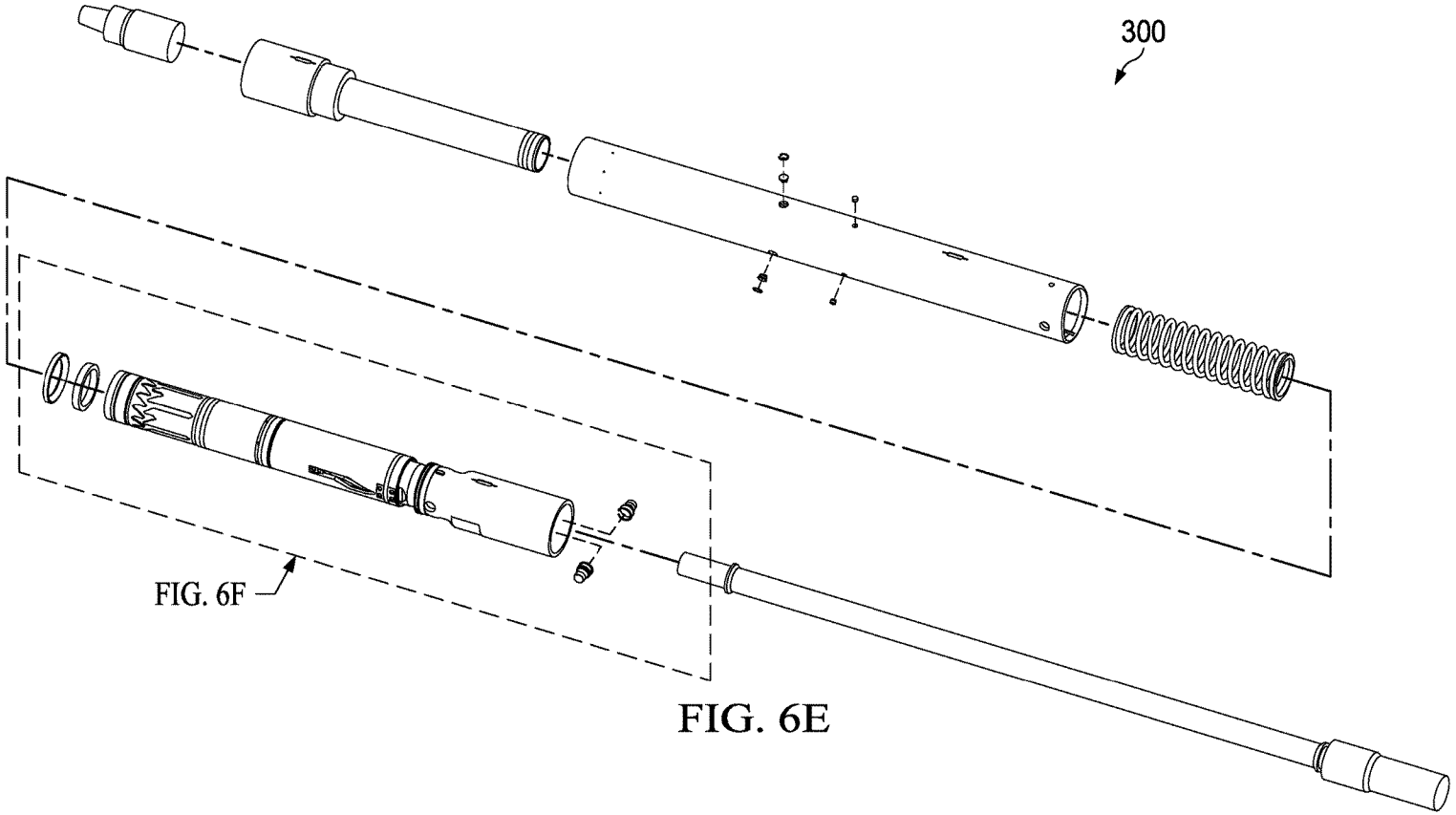
Figure 6F:
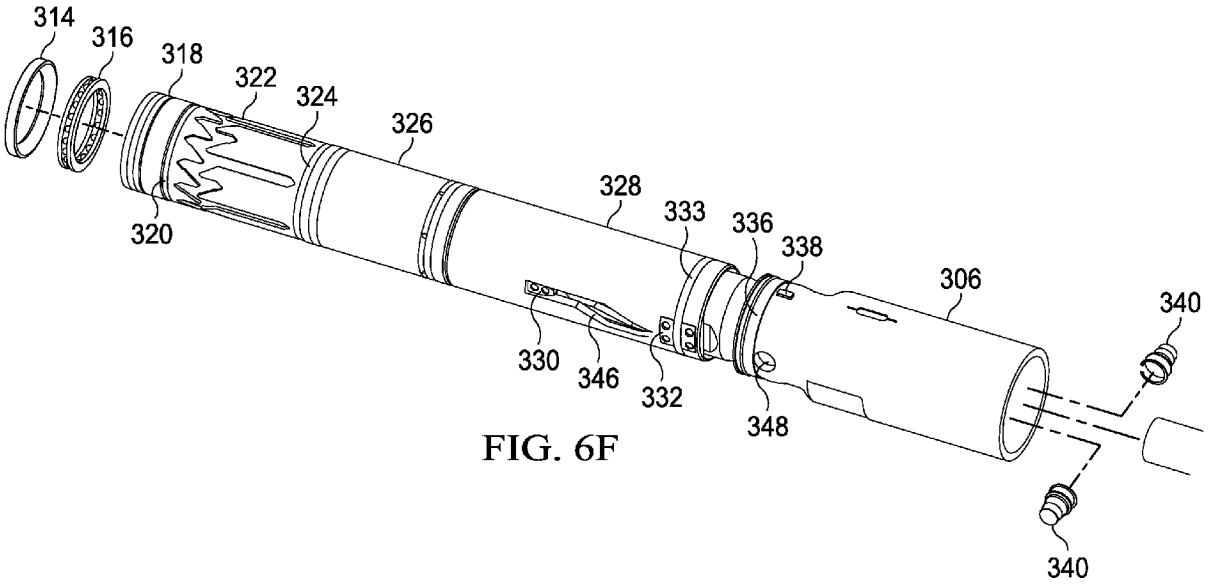
Figure 6G:
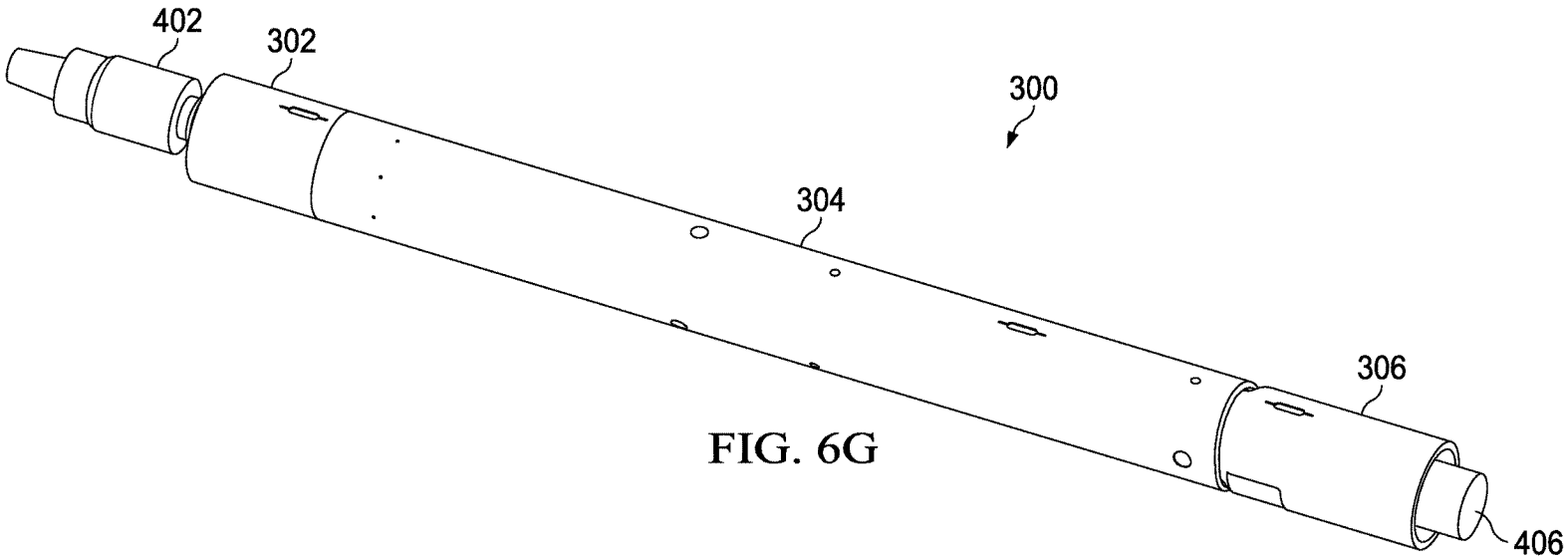

FIG. 6E shows an exploded perspective view of a downhole adjustable drilling inclination tool 300 partially assembled in accordance with one or more embodiments of the present invention. Continuing, FIG. 6F shows a detail portion of the exploded perspective view of the downhole adjustable drilling inclination tool 300 partially assembled of FIG. 6E in accordance with one or more embodiments of the present invention. In the figure, the piston assembly (which may include, for example, 318, 320, 322, 324, 326, 328, 332, 333, and 336) may be connected to the tilt housing 306 such that the lock cams 330 of the tilt housing 306 can travel in the lock cam channels 346 (only one side shown) of the second piston member 328 and the bolt plate pins 332 of the second piston member 328 can travel in the bolt plate pin channels (not shown) of the tilt housing 306. In certain embodiments, as the piston assembly moves in an axial direction, the lock cams 330 and the bolt plate pins 332 travel such that the tilt housing 306 can tilt on fulcrum pins 340 (fulcrum pin-type tilting mechanism). Continuing, FIG. 6G shows a perspective view of a downhole adjustable drilling inclination tool 300 assembled in accordance with one or more embodiments of the present invention. In the figure, assembled downhole adjustable drilling inclination tool 300, including inner housing 302, outer housing 304, and tilt housing 306, is in the straight or neutral position. As noted above, the assembly processes described above are merely illustrative and one of ordinary skill in the art will recognize that the assembly processes may vary in accordance with one or more embodiments of the present invention.

Figure 7:
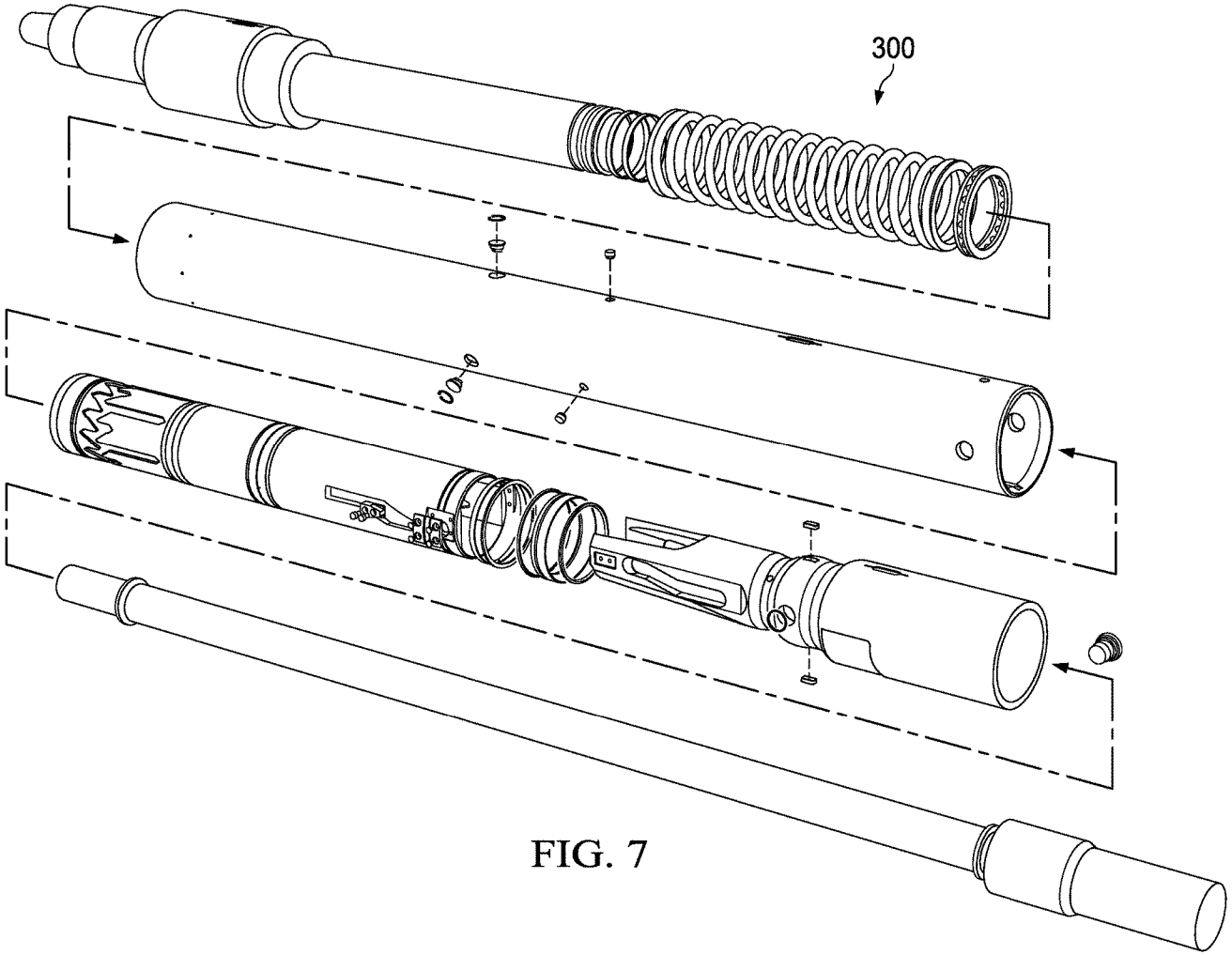
FIG. 7 shows another exploded perspective view of a downhole adjustable drilling inclination tool in accordance with one or more embodiments of the present invention.

FIG. 7 shows another exploded perspective view of a downhole adjustable drilling inclination tool 300 in accordance with one or more embodiments of the present invention. In the figure, an alternate exploded view shows how the various components may come together during an assembly process.

Figure 8A:
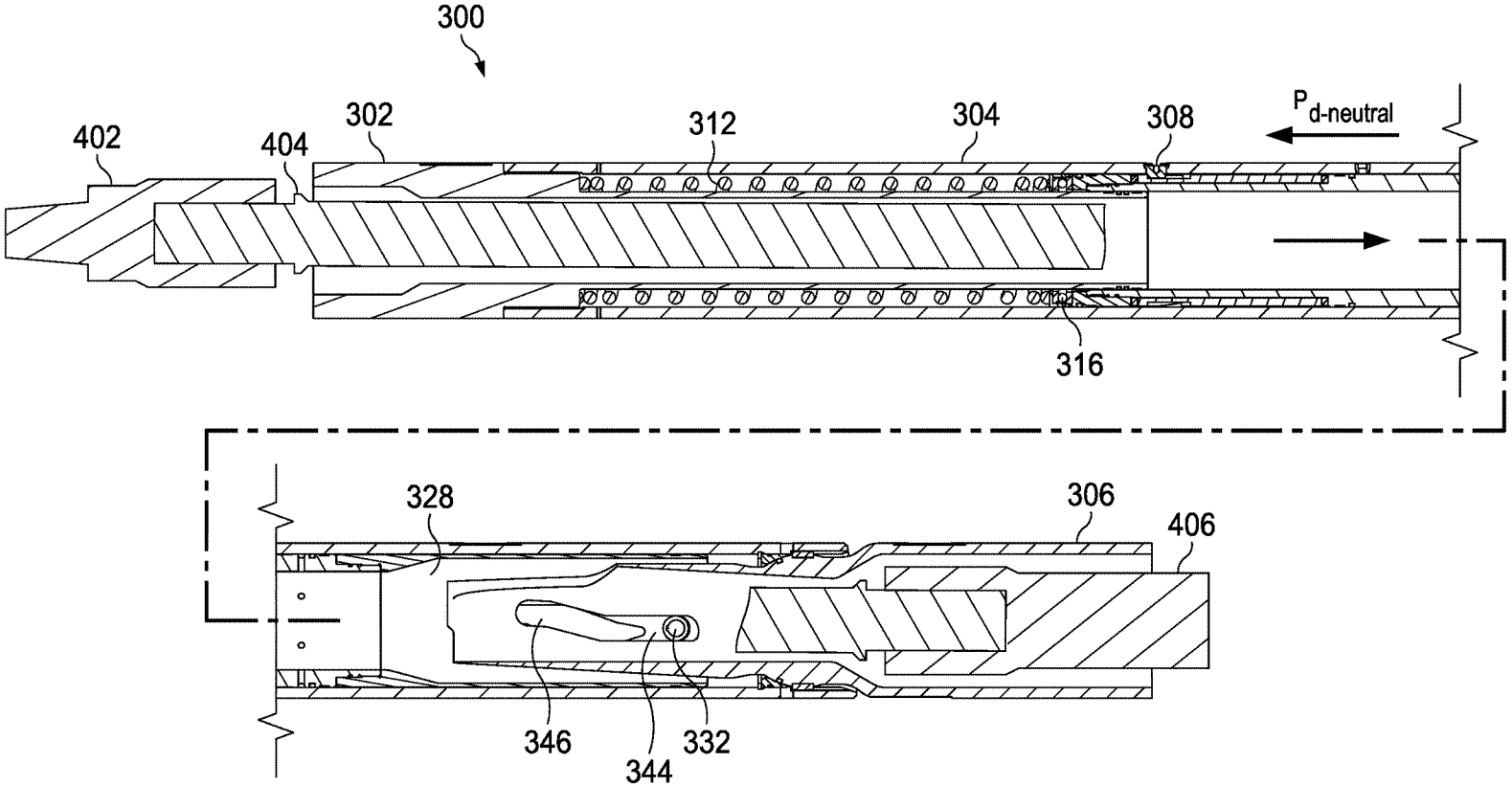
FIGS. 8A, 8B, 8C, 8D, 8E, and 8F show a cross-sectional side view and cross-sectional top side view of a downhole adjustable drilling inclination tool with a tilt housing in a neutral position, a cross-sectional side view and cross sectional top side view of the downhole adjustable drilling inclination tool with a tilt housing in a straight position, and a cross-sectional side view and cross-sectional top side view of the downhole adjustable drilling inclination tool with a tilt housing in a bent position, respectively, in accordance with one or more embodiments of the present invention.

FIG. 8A shows a cross-sectional side view of a downhole adjustable drilling inclination tool 300 with a tilt housing 306 in a neutral position in accordance with one or more embodiments of the present invention. A fluid pressure difference, Pd, between a fluid pressure through an innermost diameter of the tool 300 and a fluid pressure in an annulus (not shown) between an outermost diameter of the outer housing 304 controls the position of the piston assembly (not independently illustrated) in the neutral, straight, or bent position and the corresponding neutral, straight, or bent position of the tilt housing 306. As the fluid pressure difference, Pd, increases, the compression of compression spring 312 increases, and the piston assembly moves axially in the direction corresponding to the top of the drill string (to the left in the figure). The downhole adjustable drilling inclination tool 300 includes three positions that are fluidly controlled: neutral, straight, or bent.

Figure 8B:
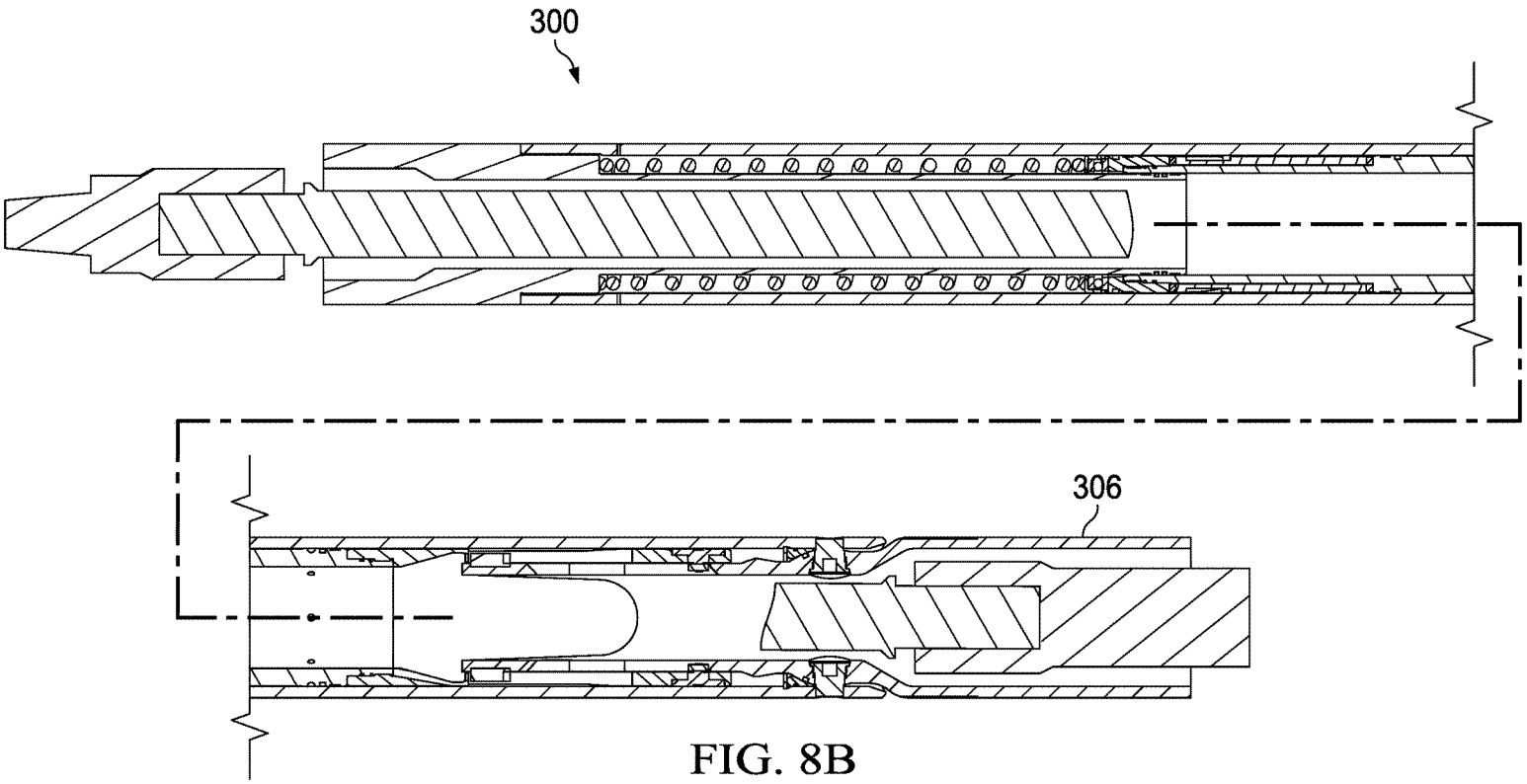

Returning to the figure, the neutral position of downhole adjustable drilling inclination tool 300 is shown. As the fluid pressure difference, $P_d$, decreases to, or below, a deactivation threshold, the compression spring 312 returns to its preloaded compression and the piston assembly (not independently illustrated) moves axially in the direction corresponding to the bottom of the drill string (to the right in the figure). The lock cam (not shown) on the facing side of the tilt housing 306 moves all the way to the left in the lock cam channel (not shown) of the second piston member 328 and the bolt plate pin 332 on the facing side of the second piston member 328 moves all the way to the right in the bolt plate pin channel 344 of the tilt housing 306, forcing the tilt housing 306 to straighten out such that its outer diameter is more or less parallel to the outer diameter of the outer housing 304, but not rigid. Continuing, FIG. 8B shows a cross-sectional top side view of the downhole adjustable drilling inclination tool 300 with the tilt housing 306 in the neutral position in accordance with one or more embodiments of the present invention.

In certain embodiments, the downhole adjustable drilling inclination tool 300 may be in a neutral position when the deactivation threshold is in a range between 0 pounds per square inch ("PSI") and 200 PSI. One of ordinary skill in the art will recognize that the deactivation threshold may vary based on an application or design, including the scale of the tool 300, in accordance with one or more embodiments of the present invention.

Figure 8C:
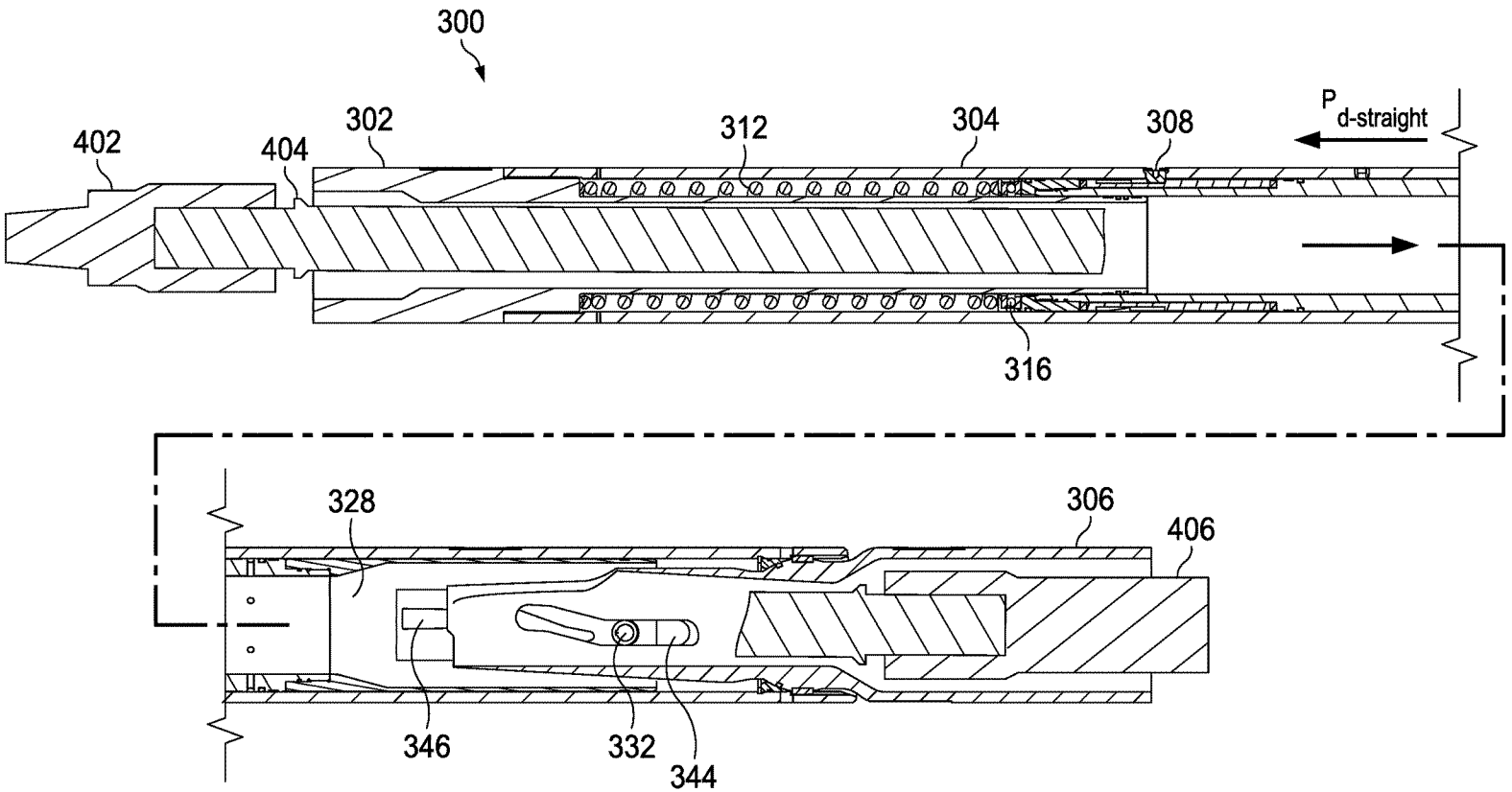
Figure 8D:
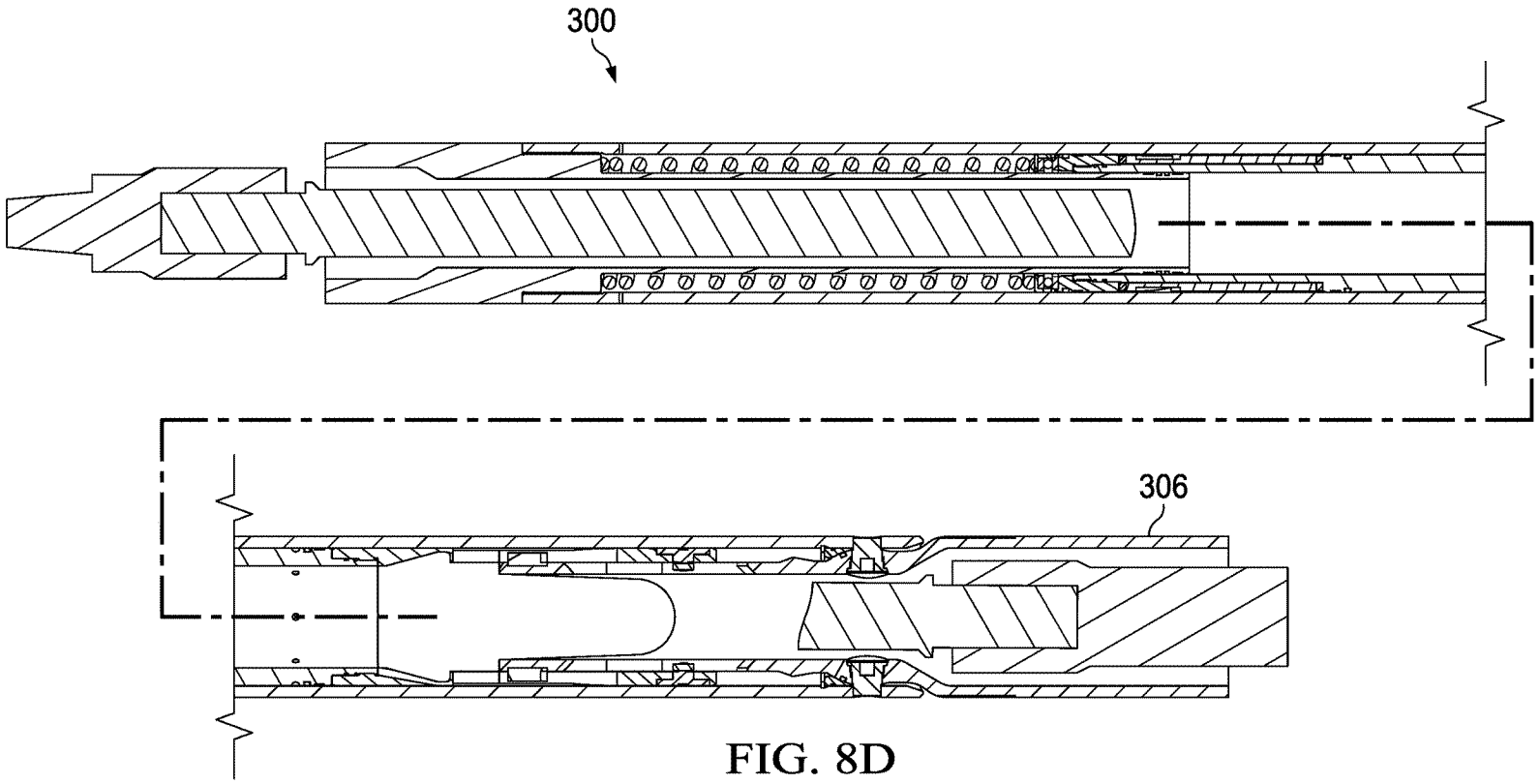

Continuing, FIG. 8C shows a cross-sectional side view of a downhole adjustable drilling inclination tool 300 with the tilt housing 306 in a straight position in accordance with one or more embodiments of the present invention. From the neutral position, as the fluid pressure difference, $P_d$, increases to, or above, an activation threshold, compression spring 312 compresses and the piston assembly moves axially in the direction corresponding to the top of the drill string (to the left in the figure) until one or more guide pins (not shown) of the outer housing (not shown) catches a straight position catch of the rotatable control ring (not shown). The lock cam (not shown) on the facing side of the tilt housing 306 moves approximately to the middle of the lock cam channel 346 of the second piston member 328 and the bolt plate pin 332 on the facing side of the second piston member 328 moves approximately to the middle of the bolt plate pin channel 344 of the tilt housing 306, where the tilt housing 306 is straight, parallel to outer housing member 304, and fixed in position until the fluid pressure difference falls to or below the deactivation threshold and returns to the neutral position. Continuing, FIG. 8D shows a cross-sectional top side view of the downhole adjustable drilling inclination tool 300 with the tilt housing 306 in the straight position in accordance with one or more embodiments of the present invention.

In certain embodiments, the downhole adjustable drilling inclination tool 300 may transition to the straight position when the activation threshold is at least 265 PSI or higher. One of ordinary skill in the art will recognize that the activation threshold may vary based on an application or design, including the scale of the tool, in accordance with one or more embodiments of the present invention.

Figure 8E:
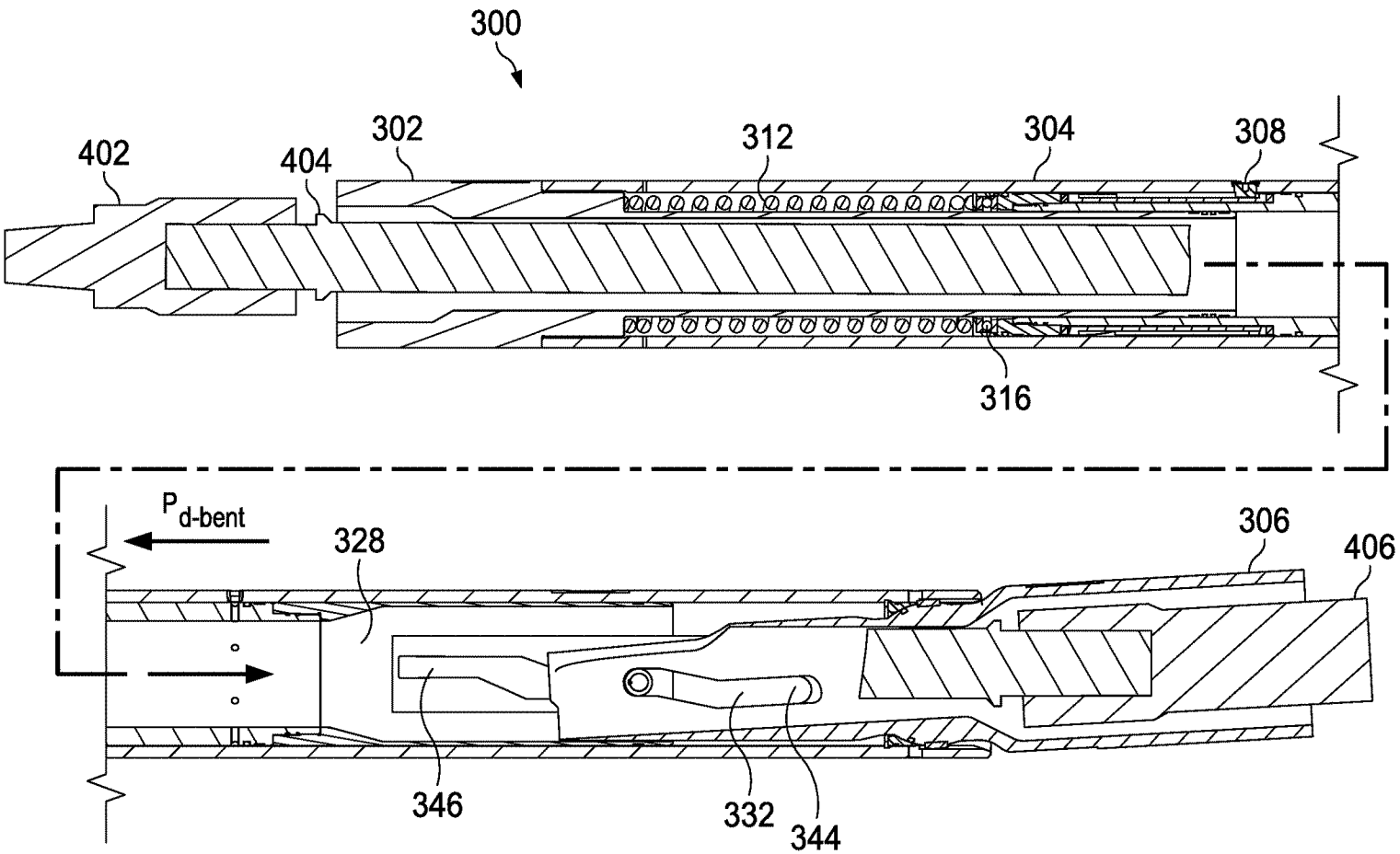
Figure 8F:
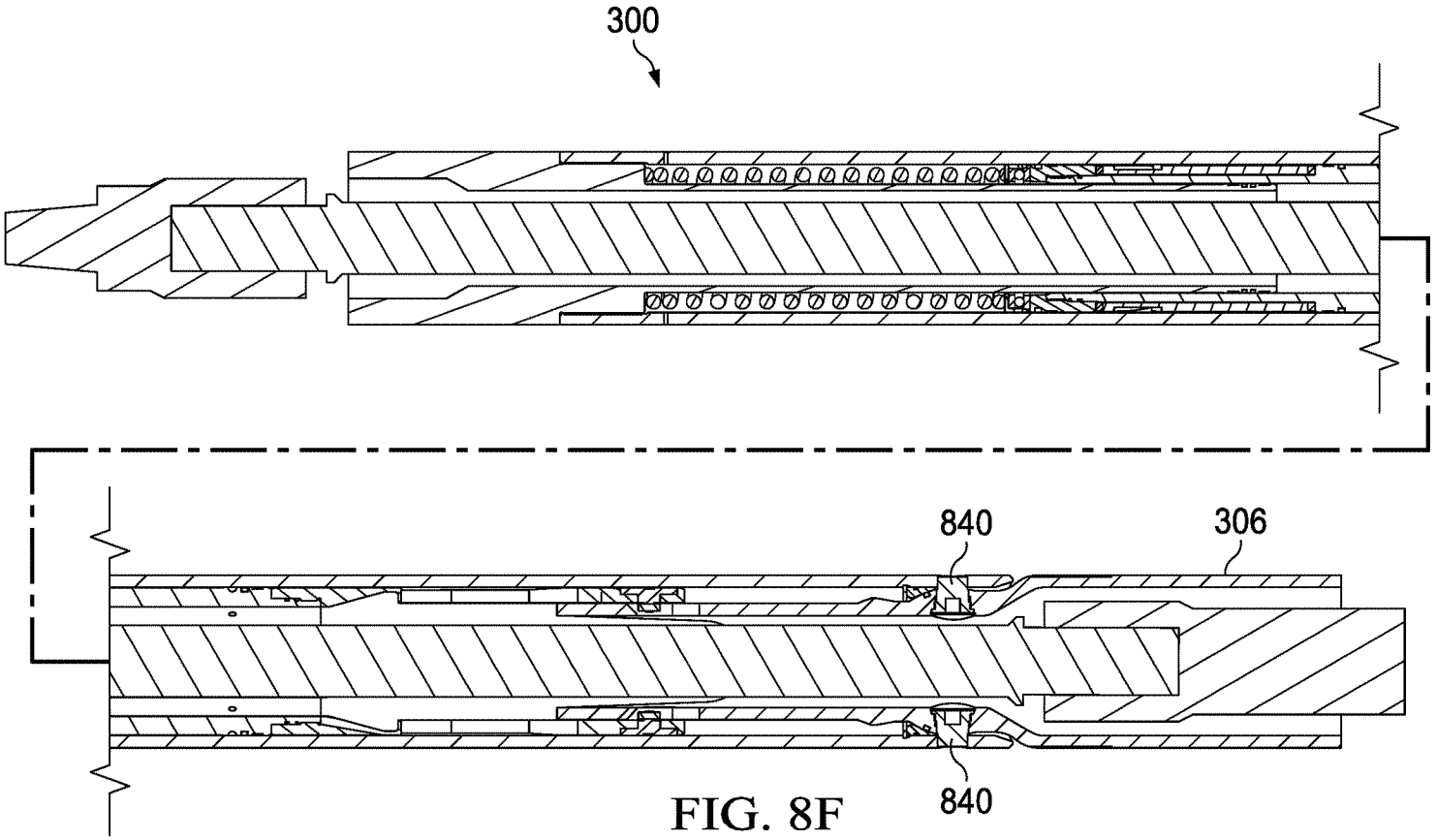

Continuing, FIG. 8E shows a cross-sectional side view of a downhole adjustable drilling inclination tool 300 in a bent position in accordance with one or more embodiments of the present invention. Upon returning to the neutral position from the straight position, once the fluid pressure difference, $P_d$, increases to, or above, the activation threshold, the compression spring 312 compresses and the piston assembly moves axially in the direction corresponding to the top of the drill string (left in the figure) until one or more guide pins (not shown) of the outer housing (not shown) catches a bent position catch of the rotatable control ring (not shown). The lock cam (not shown) on the facing side of the tilt housing 306 moves all the way to the right in the lock cam channel 346 of the second piston member 328 and the bolt plate pin 332 on the facing side of the second piston member 328 moves all the way to the left in the bolt plate pin channel 344 of the tilt housing 306, forcing the tilt housing 306 to tilt on the fulcrum pins (not shown) and tilt the tilt housing 306. Continuing, FIG. 8F shows a cross-sectional top side view of the downhole adjustable drilling inclination tool 300 in a bent position in accordance with one or more embodiments of the present invention. A plurality of fulcrum pins 340 may be seen in this view.

In certain embodiments, the downhole adjustable drilling inclination tool 300 may transition to the bent position when the activation threshold is at least 265 PSI or higher. As noted above, the tool 300 is initially in the neutral position when the fluid pressure difference, $P_d$, is at or below the deactivation threshold. Upon application of sufficient fluid pressure such that the fluid pressure difference, $P_d$, is at or above the activation threshold, the tool 300 may transition to the straight position. Upon removal of fluid pressure such that the fluid pressure difference, $P_d$, falls to or below the deactivation threshold, the tool 300 returns to the neutral position. Upon the next application of fluid pressure such that the fluid pressure difference, $P_d$, is at or above the activation threshold, the tool 300 may transition to the bent position. The determination of whether the tool 300 is in the straight or bent position may be determined by a pressure measurement device, the determination of which is discussed in more detail herein. One of ordinary skill in the art will recognize that the activation threshold may vary based on an application or design, including the scale of the tool, in accordance with one or more embodiments of the present invention.

Figure 9A:
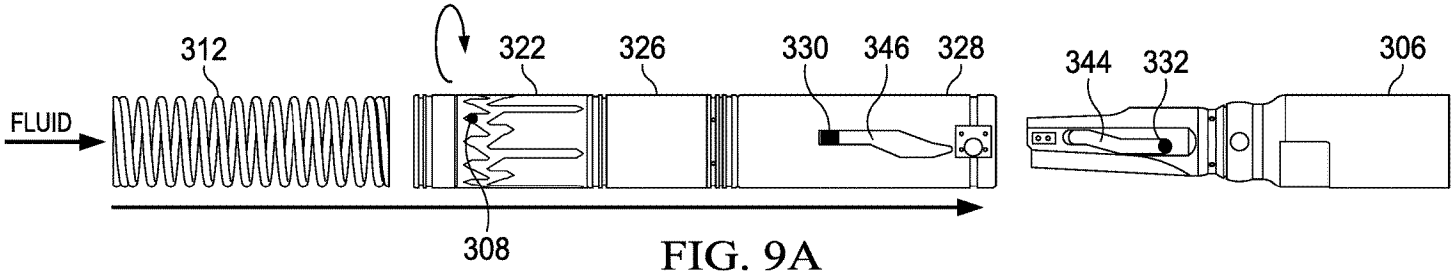
FIGS. 9A, 9B, and 9C show a state diagram of the state of the compression spring, piston assembly, and tilt housing of a downhole adjustable drilling inclination tool in a neutral position, straight position, and bent position respectively in accordance with one or more embodiments of the present invention.

FIG. 9A shows a state diagram of the state of the compression spring 312, piston assembly (including, but not limited to, 322, 326, 328, and 332), and tilt housing 306 in a neutral position in accordance with one or more embodiments of the present invention. In the state diagrams, various components are shown to illustrate their relative relationships that cause the orientation of the tilt housing 306 between the various positions of neutral, straight, and bent. As noted above, when the fluid pressure difference, $P_d$, is at or below a deactivation threshold, compression spring 312 decompresses to its preloaded compression, the piston assembly moves axially in the direction corresponding to the bottom of the drill string (to the right in the figure), and one or more guide pins (not shown) of the outer housing (not shown) catch a neutral position catch of rotatable control ring 322 to hold the piston assembly in a neutral position so long as the fluid pressure difference, $P_d$, is at or below the deactivation threshold. As the piston assembly moves, one or more lock cams 330 of the tilt housing 306 are positioned all the way in the direction corresponding to the top of the drill string in one or more lock cam channels 346 of the second piston member 328, and one or more bolt plate pins 332 of the second piston member 328 move all the way in the direction corresponding to the bottom of the drill string in one or more bolt plate pin channels 344 of the tilt housing 306, thus positioning tilt housing 306 in the neutral position.

Figure 9B:
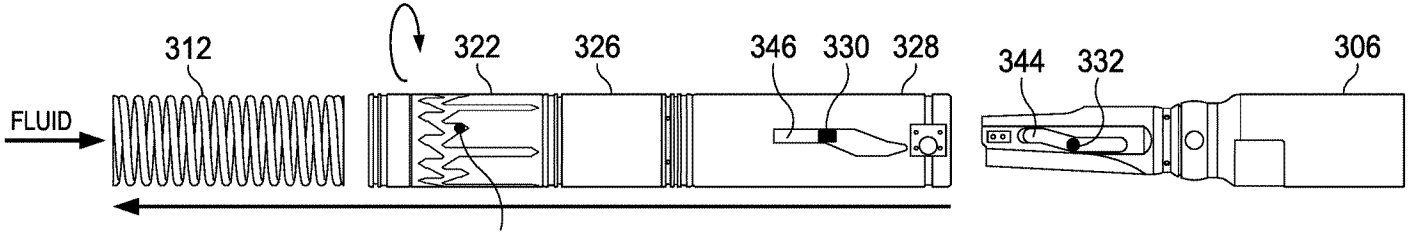

Continuing, FIG. 9B shows a state diagram of the state of the compression spring 312, piston assembly (including, but not limited to, 322, 326, 328, and 332), and tilt housing 306 in a straight position in accordance with one or more embodiments of the present invention. From the neutral position, when the fluid pressure difference, $P_d$, reaches or exceeds an activation threshold, compression spring 312 compresses, the piston assembly moves axially in the direction corresponding to the top of the drill string (to the left in the figure), and one or more guide pins (not shown) of the outer housing (not shown) catch a straight position catch of rotatable control ring 322 to hold the piston assembly in a straight position so long as the fluid pressure difference, $P_d$, is at or above the activation threshold. As the piston assembly moves, one or more lock cams 330 of the tilt housing 306 are positioned approximately in the middle of one or more lock cam channels 346 of the second piston member 328, and one or more bolt plate pins 332 of the second piston member 328 move to approximately the middle of one or more bolt plate pin channels 344 of the tilt housing 306, thus positioning tilt housing 306 in the straight position.

Figure 9C:
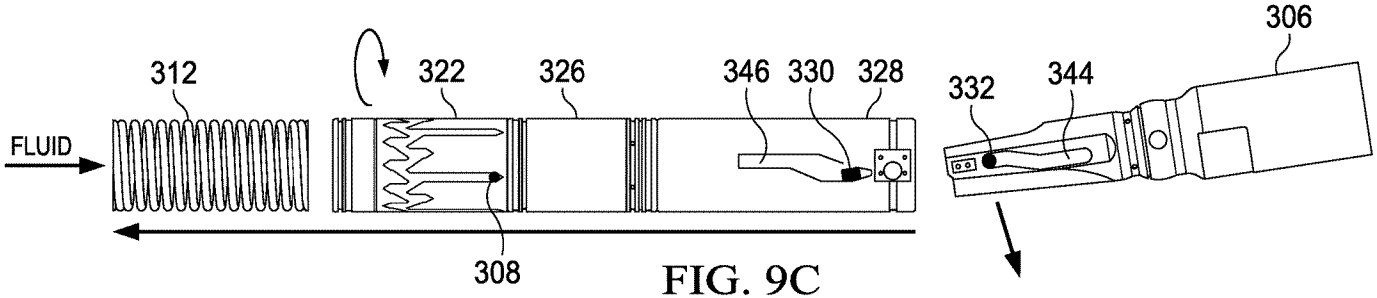

Continuing, FIG. 9C shows a state diagram of the state of the compression spring 312, piston assembly (including 322, 326, and 328), and tilt housing 306 in a bent position in accordance with one or more embodiments of the present invention. Upon returning to the neutral position from the straight position (not shown), when the fluid pressure difference, $P_d$, increases to or above the activation threshold, compression spring 312 compresses, the piston assembly moves axially in the direction corresponding to the top of the drill string (left in the figure), and one or more guide pins (not shown) of the outer housing (not shown) catch a bent position catch of rotatable control ring 322 to hold the piston assembly in a bent position so long as the fluid pressure difference, $P_d$, is at or above the activation threshold. As the piston assembly moves, one or more lock cams 330 of the tilt housing 306 are positioned all the way in a direction corresponding to the bottom of the drill string in one or more lock cam channels 346 of the second piston member 328, and one or more bolt plate pins 332 of the second piston member 328 move all the way in the direction corresponding to the top of the drill string in one or more bolt plate pin channels 344 of the tilt housing 306. Tilt housing 306 pivots on fulcrum pins (not shown), thus positioning tilt housing 306 in the bent position.

In one or more embodiments of the present invention, the downhole adjustable drilling inclination tool 300 may be used in hole sizes of 12.25" diameter and larger. In such embodiments, the outermost diameter of the tool 300 may be between 9.5" and 9.625" and may accommodate drive shafts 404 having an outermost diameter of 4". In other embodiments, tool 300 may be scaled to have an outermost diameter of 11.25", 8", 7.75", 6.5", and 4.75" for using in drilling holes of other sizes. One of ordinary skill in the art will recognize that downhole adjustable drilling inclination tool 300 may be scaled to accommodate different tool 300 sizes for different holes sizes in accordance with one or more embodiments of the present invention.

In FIGS. 10 through 20, a number of components that may be used in one or more embodiments of the present invention are shown for illustrative purposes only. However, one of ordinary skill in the art will recognize that these components may vary in shape, size, number, and structure in accordance with one or more embodiments of the present invention.

FIG. 10A shows a top distal end view of an inner housing 302 of a downhole adjustable drilling inclination tool 300 in accordance with one or more embodiments of the present invention. In certain embodiments, inner housing 302 may be a substantially cylindrical member with a top end portion 1010 having a top distal end opening configured to receive a portion of a top drive shaft coupling (not shown) through a first inner diameter 1020 and a second inner diameter 1030 through which a drive shaft (not shown) may be disposed. In other embodiments, inner housing 302 may be a substantially cylindrical member with a first inner diameter 1020 equal to a second inner diameter 1030. An outer diameter of the top end portion 1010 of inner housing 302 is substantially equal to an outer diameter of an outer housing (not shown). The top end portion 1010 may include threading to join to the power section (not shown) of the bottomhole assembly (not shown).

Continuing, FIG. 10B shows a side view of inner housing 302 of downhole adjustable drilling inclination tool 300 in accordance with one or more embodiments of the present invention. Inner housing 302 may include an intermediate portion 1040 having an outer diameter smaller than an inner diameter of the outer housing. Intermediate portion 1040 has the second inner diameter 1030 through which the drive shaft may be disposed. Second inner diameter 1030 allows for the drive shaft to rotate as well as for mud to flow through its interior. Intermediate portion 1040 may include threading on its outer diameter configured to join inner housing 302 to the outer housing. Inner housing 302 may include a bottom end portion 1050 configured to receive a compression spring (not shown) about an outer diameter of the bottom end portion 1050. Bottom end portion 1050 has an outer diameter smaller than the outer diameter of the intermediate portion 1040, both of which are configured to be disposed within the outer housing (not shown) when the downhole adjustable drilling inclination tool 300 is assembled. Bottom end portion 1050 may include a plurality of grooves 1060 configured to hold a plurality of seals (not shown) and/or slide rings (not shown).

Continuing, FIG. 10C shows a bottom distal end view of the inner housing 302 of the downhole adjustable drilling inclination tool 300 in accordance with one or more embodiments of the present invention. Continuing, FIG. 10D shows a cross-sectional side view of the inner housing 302 of the downhole adjustable drilling inclination tool 300 in accordance with one or more embodiments of the present invention. Continuing, FIG. 10E shows a perspective view of the inner housing 302 of the downhole adjustable drilling inclination tool 300 in accordance with one or more embodiments of the present invention.

Figure 11B:
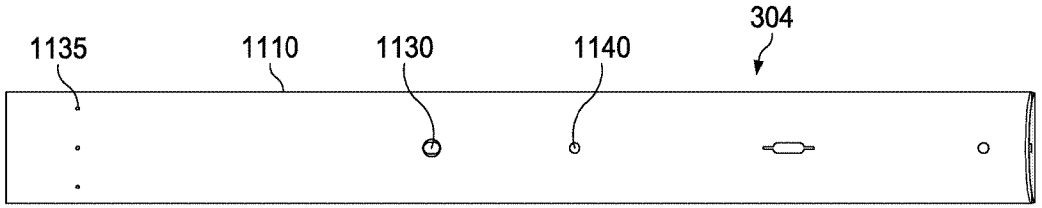
FIGS. 11A, 11B, 11C, 11D, and 11E show a top distal end view, top side view, bottom distal end view, cross-sectional top side view, and perspective view respectively of an outer housing (of a fulcrum pin-type tilting mechanism) of a downhole adjustable drilling inclination tool in accordance with one or more embodiments of the present invention.
Figure 11D:
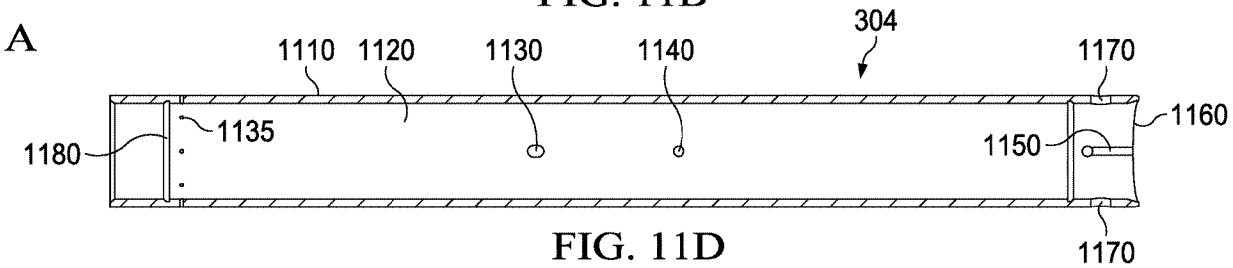
Figure 11E:
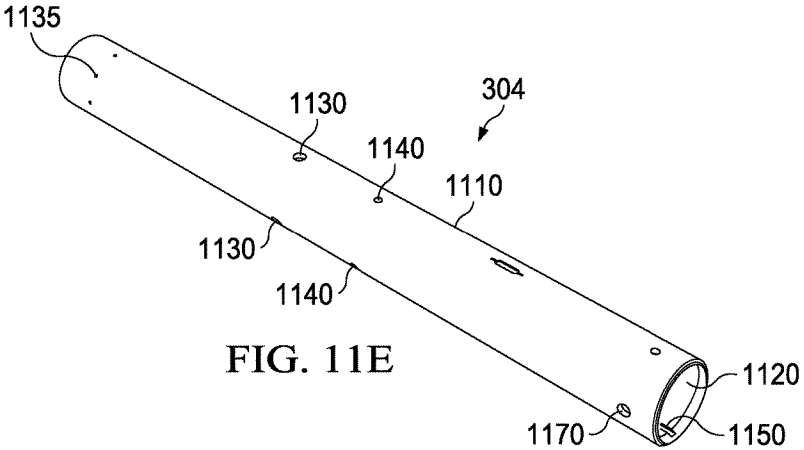
Figure 11A:
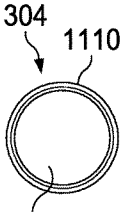

FIG. 11A shows a top distal end view of an outer housing 304 (of the fulcrum pin-type tilting mechanism) of a downhole adjustable drilling inclination tool 300 in accordance with one or more embodiments of the present invention. Outer housing 304 may be a cylindrical member having a tool defining outer diameter 1110 and a hollow inner diameter 1120. Continuing, FIG. 11B shows a top side view of the outer housing 304 of the downhole adjustable drilling inclination tool 300 in accordance with one or more embodiments of the present invention. Outer housing 304 may include a plurality of pressure equalization holes 1135 that assist in equalizing the pressure between the compression spring chamber and the annulus. Outer housing 304 may include a plurality of guide pin ports 1130 configured to receive a plurality of guide pins 308, that extend into the hollow inner diameter 1120 of the outer housing 304 and engage the rotatable control ring (not shown) to lock in the piston assembly positions (not shown). Outer housing 304 may include a plurality of pressure bleed holes 1140 that may be used with a pressure measurement device (not shown) to determine the condition (straight or bent) of the downhole adjustable drilling inclination tool 300. In either the straight or bent position of the tilt housing, a portion of the internal fluid pressure within the tool 300 will bleed out to the annulus. The pressure measurement device can detect differences of at least 40 PSI between the straight and the bent positions. For example, if the tool 300 is in the straight position with a certain input flow and pump pressure, the internal fluid pressure may be approximately 400 PSI down the borehole. When switched to the bent position, using the same input flow and pump pressure, the pressure measurement device would measure an internal fluid pressure of approximately 360 PSI down the borehole. The pressure bleed is facilitated by the piston assembly where a plurality of pressure bleed holes (1450 of FIG. 14) in the first piston member (326 of FIG. 14) line up with the plurality of pressure bleed holes 1140 of the outer housing 304 when the tool 300 is in the straight position and the plurality of pressure bleed holes (1450 of FIG. 14) in the first piston member (326 of FIG. 14) are offset with the plurality of pressure bleed holes 1140 of the outer housing 304 when the tool 300 in the bent position, such that the pressure bleed is reduced and the difference is measurable by the pressure measurement device. Outer housing 304 may include a torque key port 1150 in which a torque key (not shown) will rest. Outer housing 304 may include an angled or chamfered portion 1160 on the end that allows for the tilt housing (not shown) to tilt in the bent position of the tool 300.

Figure 11C:
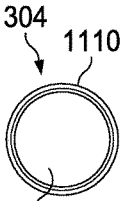

Continuing, FIG. 11C shows a bottom distal end view of the outer housing 304 of the downhole adjustable drilling inclination tool 300 in accordance with one or more embodiments of the present invention. Continuing, FIG. 11D shows a cross-sectional top side view of the outer housing 304 of the downhole adjustable drilling inclination tool 300 in accordance with one or more embodiments of the present invention. Inner diameter 1120 may include threads 1180 configured to join outer housing 304 to the inner housing (not shown). In this view, the angled portion 1160 that allows the tilt housing to tilt can more easily be seen. Outer housing 304 may include a plurality of fulcrum pin ports 1170 configured to receive fulcrum pins 340 that join the tilt housing to outer housing 304. Continuing, FIG. 11E shows a perspective view of the outer housing 304 of the downhole adjustable drilling inclination tool 300 in accordance with one or more embodiments of the present invention.

Figure 12B:
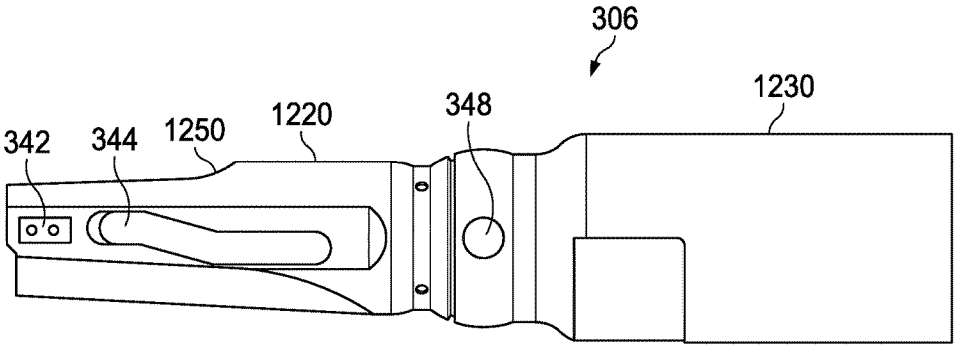
FIGS. 12A, 12B, 12C, 12D, 12E, 12F, 12G, 12H, and 12I show a top distal end view, side view, bottom distal end view, cross-sectional side view, top side view, cross-sectional top side view, bottom side view, top distal end facing perspective view, and bottom distal end facing perspective view, respectively, of a tilt housing (of a fulcrum pin-type tilting mechanism) of a downhole adjustable drilling inclination tool in accordance with one or more embodiments of the present invention.
Figure 12A:
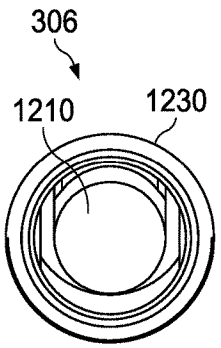

FIG. 12A shows a top distal end view of a tilt housing 306 (of the fulcrum pin-type tilting mechanism) of a downhole adjustable drilling inclination tool 300 in accordance with one or more embodiments of the present invention. From this top distal end view, corresponding to the top most side closest to the surface, tilt housing 306 has an innermost diameter 1210 configured to receive the drive shaft (not shown). Continuing, FIG. 12B shows a side view of the tilt housing 306 of the downhole adjustable drilling inclination tool 300 in accordance with one or more embodiments of the present invention. Tilt housing 306 may include a top end portion 1220 and a bottom end portion 1230. Top end portion 1220 may be configured to fit inside the inner diameter of the second piston member (not shown). Top end portion 1220 may include a plurality of lock cam receivers 342 (only one side shown) configured to receive a plurality of lock cams (not shown) that travel in a plurality of lock cam channels (not shown) of the second piston member (not shown). Top end portion 1220 may include a plurality of bolt plate pin channels 344 (only one side shown) configured to receive a plurality of bolt plate pins (not shown) of the second piston member (not shown) that travel in the channels 344. Top end portion 1220 may include a substantially U-shaped cutout 1250 to allow for movement of the drive shaft when the tilt housing 306 is in the bent position. Bottom end portion 1230 may be configured to receive a portion of the drive shaft (not shown) and the bottom drive shaft coupling (not shown). Bottom end portion 1230 may include a plurality of fulcrum pin ports 348 (only one side shown) configured to receive a plurality of fulcrum pins (not shown) from inside the tilt housing 306 and connecting to the outer housing (not shown), such that tilt housing 306 can pivot on the plurality of fulcrum pins when transitioning to and from the bent position.

Figure 12C:
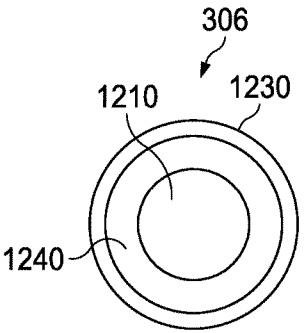
Figure 12D:
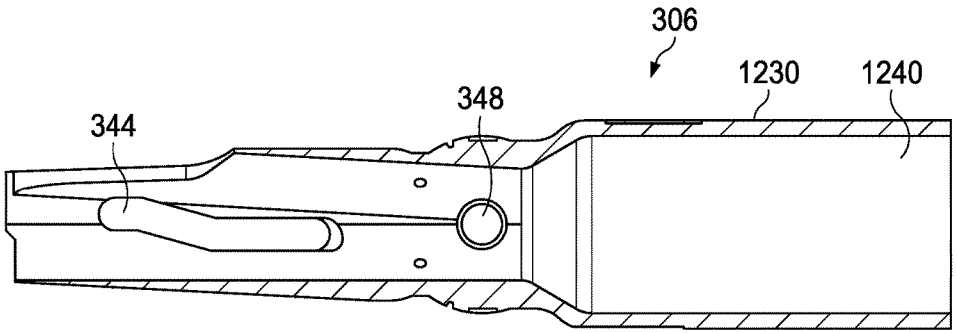
Figure 12E:
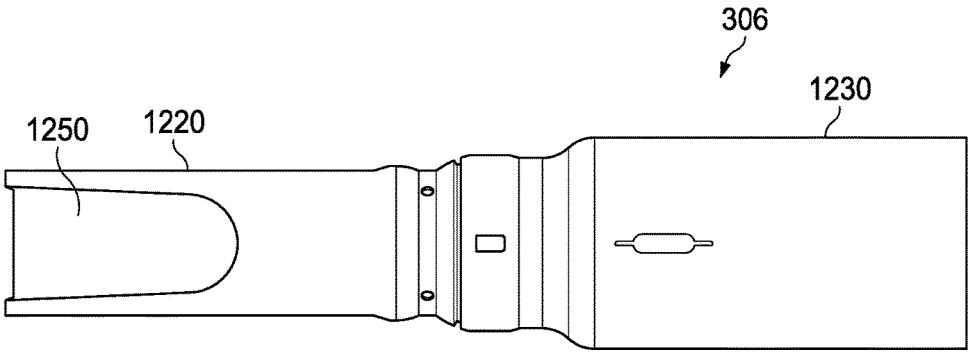
Figure 12F:
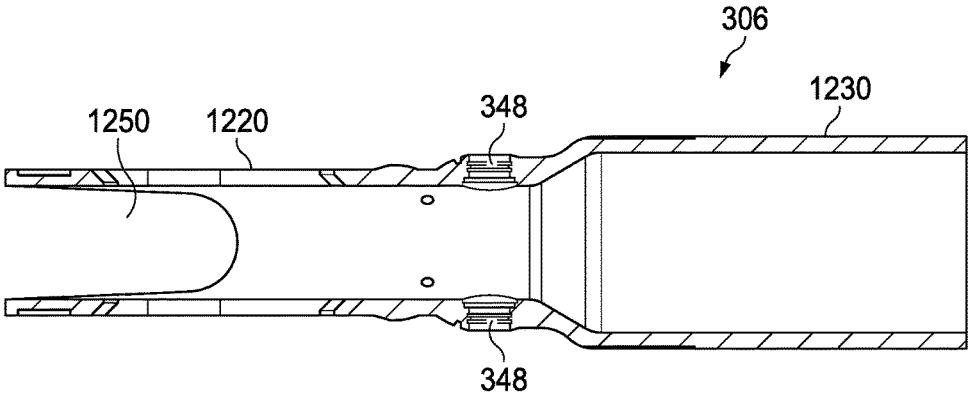
Figure 12G:
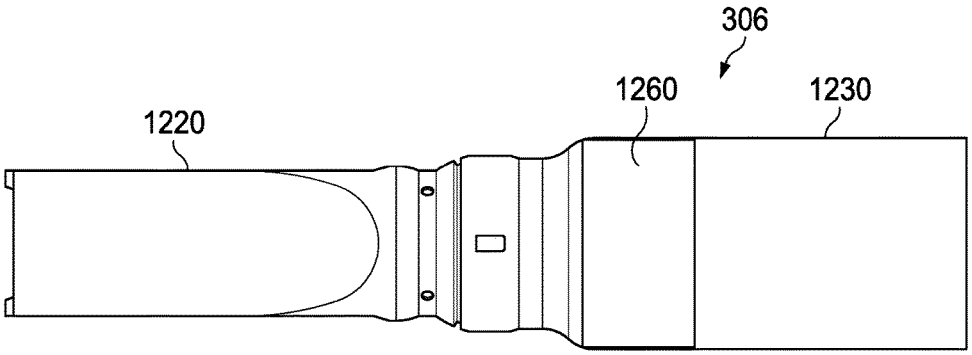
Figure 12H:
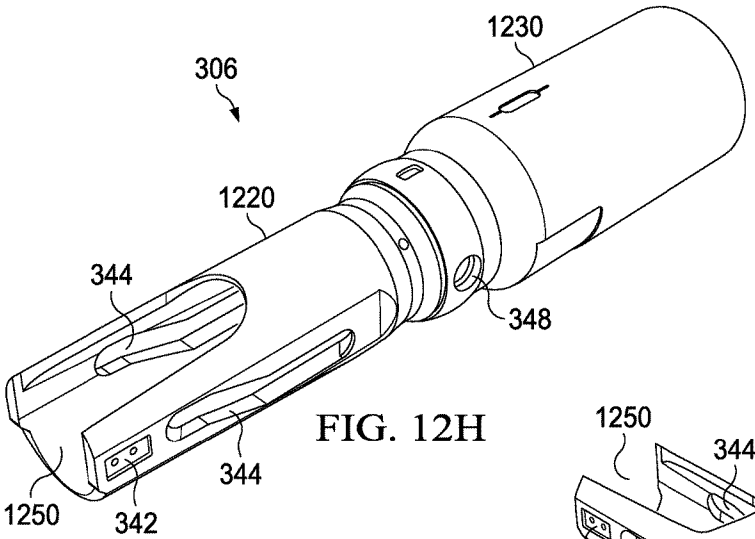

Continuing, FIG. 12C shows a bottom distal end view of the tilt housing 306 of the downhole adjustable drilling inclination tool 300 in accordance with one or more embodiments of the present invention. From this bottom distal end view, corresponding to the bottom most side closest to the drill bit (not shown), tilt housing 306 has an innermost diameter 1210 configured to receive the drive shaft (not shown) and a larger diameter portion 1240 configured to receive the top drive shaft coupling (not shown). Continuing, FIG. 12D shows a cross-sectional side view of the tilt housing 306 of the downhole adjustable drilling inclination tool 300 in accordance with one or more embodiments of the present invention. Continuing, FIG. 12E shows a top side view of the tilt housing 306 of the downhole adjustable drilling inclination tool 300 in accordance with one or more embodiments of the present invention. Tilt housing 306 may include a substantially U-shaped cutout 1250 to allow for movement of the drive shaft when the tilt housing 306 is in the bent position. Continuing, FIG. 12F shows a cross-sectional top side view of the tilt housing 306 of the downhole adjustable drilling inclination tool 300 in accordance with one or more embodiments of the present invention. In this view, the plurality of fulcrum pin ports 348 are shown. Continuing, FIG. 12G shows a bottom side view of the tilt housing 306 of the downhole adjustable drilling inclination tool 300 in accordance with one or more embodiments of the present invention. Tilt housing 306 may include a cutout 1260 to be hard-faced to prevent wear from operative use. On the opposite side of the cutout that is hard-faced (see FIG. 12E) there may be a milled area where ID-numbering may be placed.

Figure 12I:
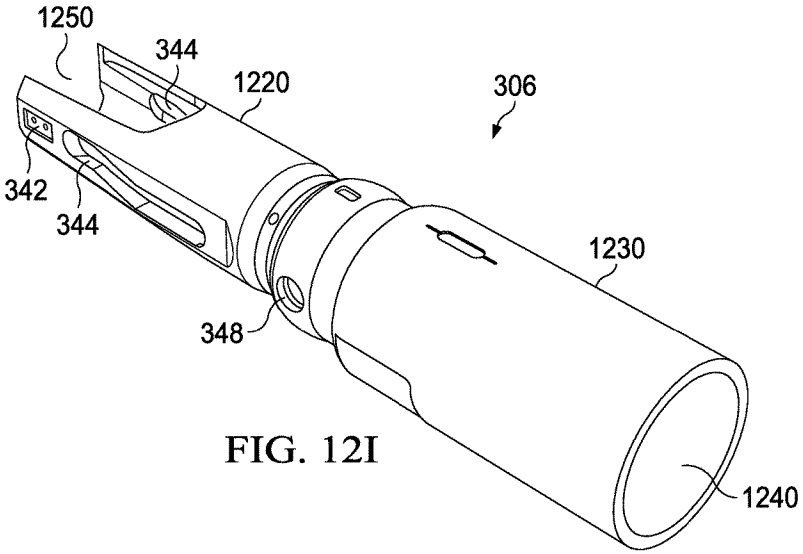

Continuing, FIG. 1211 shows a top distal end facing perspective view of the tilt housing 306 of the downhole adjustable drilling inclination tool 300 in accordance with one or more embodiments of the present invention. Top end portion 1220 of tilt housing 306 may be disposed within the outer housing and includes a plurality of lock cam receivers 342 where a plurality of lock cams (not shown) may be secured that travel in a plurality of lock cam channels (not shown) of the second piston member to pivot tilt housing 306 on a plurality of fulcrum pins (not shown) that connect tilt housing 306 to the outer housing and position tilt housing 306 in a neutral, straight, or bent position corresponding to the neutral, straight, or bent position of the piston assembly (not shown). Continuing, FIG. 12I shows a bottom distal end facing perspective view of the tilt housing 306 of the downhole adjustable drilling inclination tool 300 in accordance with one or more embodiments of the present invention.

Figure 13C:
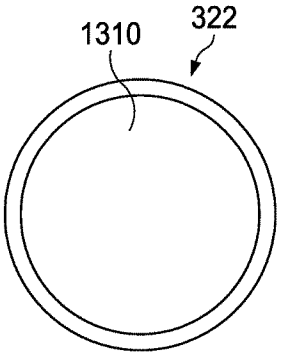
FIGS. 13A, 13B, 13C, and 13D show a top distal end view, side view, bottom distal end view, and perspective view respectively of a rotatable control ring of a downhole adjustable drilling inclination tool in accordance with one or more embodiments of the present invention.
Figure 13B:
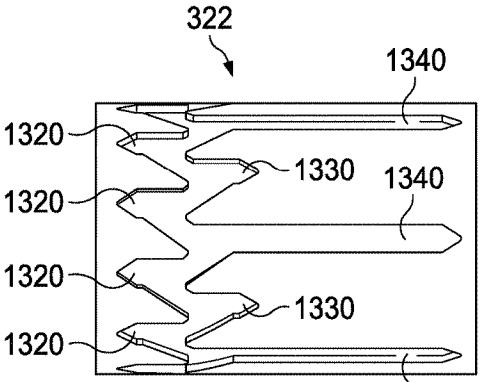
Figure 13D:
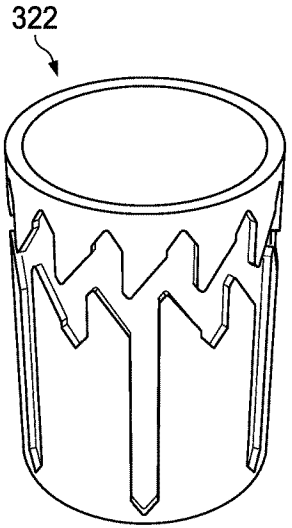
Figure 13A:
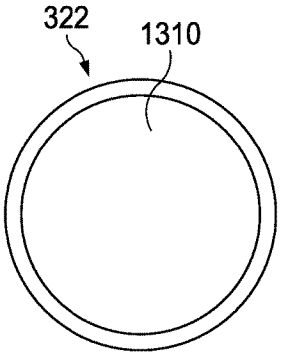

FIG. 13A shows a top distal end view of a rotatable control ring 322 of a downhole adjustable drilling inclination tool 300 in accordance with one or more embodiments of the present invention. Rotatable control ring 322 may have a hollow inner diameter 1310. Continuing, FIG. 13B shows a side view of the rotatable control ring 322 of the downhole adjustable drilling inclination tool 300 in accordance with one or more embodiments of the present invention. Rotatable control ring 322 may include a blind track with three types of catch positions that are repeated around the outer circumference of the rotatable control ring 322, including a plurality of neutral position catches 1320, a plurality of straight position catches 1330, and a plurality of bent position catches 1340 to hold a neutral, straight, or bent position of the piston assembly (not shown) and the corresponding neutral, straight, or bent position of the tilt housing (not shown). As noted above, downhole adjustable drilling inclination tool 300 may initially be in the neutral position, such that one or more guide pins (not shown) are caught in one or more neutral position catches 1320. Upon application of fluid pressure such that the fluid pressure difference, $P_d$, reaches or exceeds the activation threshold, rotatable control ring 322 rotates and catches the next catch in the track, a straight position catch 1330. Once the fluid pressure difference, $P_d$, falls to or below the deactivation threshold, rotatable control ring 322 rotates and catches the next catch in the track, a neutral position catch 1320. Upon the next application of fluid pressure such that the fluid pressure difference, $P_d$, reaches or exceeds the activation threshold, rotatable control ring 322 rotates and catches the next catch in the track, a bent position catch 1340. As such, the repeated pattern neutral, straight, neutral, and bent catches allows for consistent switching between positions and the depth of each catch may be selected to allow for the appropriate compression of the compression spring (not shown) used (which may vary with the scale of the tool 300) so that it corresponds to desired activation and deactivation thresholds (which also may vary based on an application or design). Continuing, FIG. 13C shows a bottom distal end view of the rotatable control ring 322 of the downhole adjustable drilling inclination tool 300 in accordance with one or more embodiments of the present invention. Continuing, FIG. 13D shows a perspective view of the rotatable control ring 322 of the downhole adjustable drilling inclination tool 300 in accordance with one or more embodiments of the present invention.

Figure 14C:
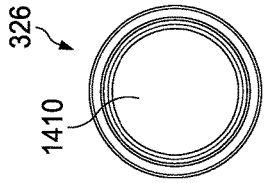
FIGS. 14A, 14B, 14C, 14D, and 14E show a top distal end view, side view, bottom distal end view, cross-sectional side view, and perspective view respectively of a first piston member of a downhole adjustable drilling inclination tool in accordance with one or more embodiments of the present invention.
Figure 14B:
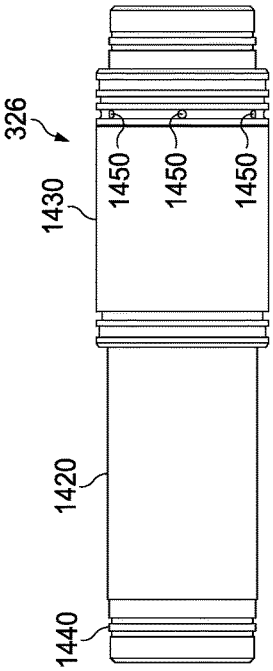
Figure 14A:
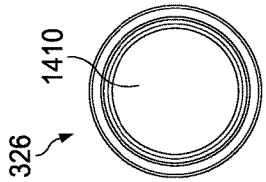
Figure 14E:
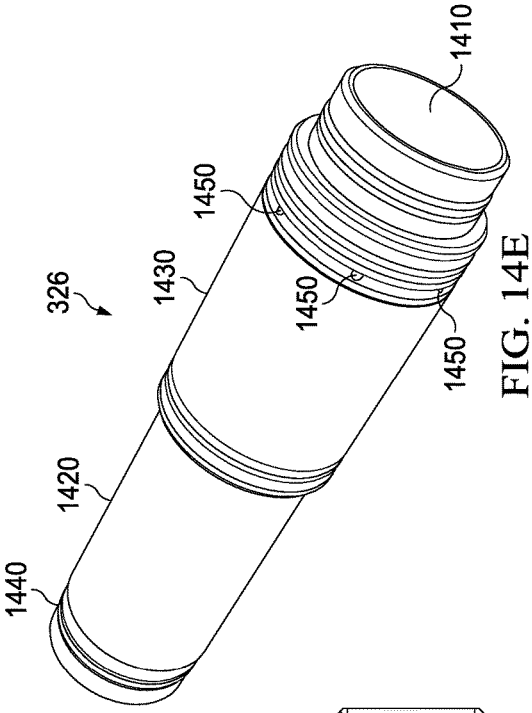
Figure 14D:
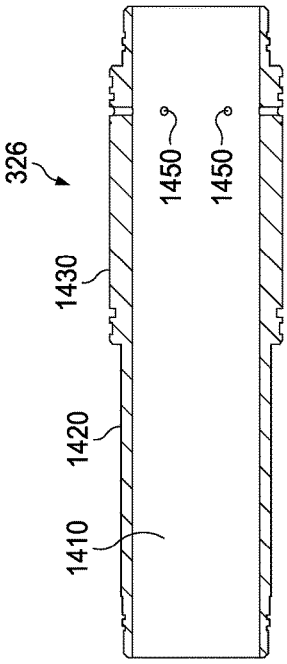

FIG. 14A shows a top distal end view of a first piston member 326 of a downhole adjustable drilling inclination tool 300 in accordance with one or more embodiments of the present invention. First piston member 326 may include a hollow inner diameter 1410. Continuing, FIG. 14B shows a side view of the first piston member 326 of the downhole adjustable drilling inclination tool 300 in accordance with one or more embodiments of the present invention. First piston member 326 may include a top end portion 1420 and a bottom end portion 1430 that has substantially the same diameter as that of the outer housing (not shown). Top end portion 1420 has an outer diameter about which the rotatable control ring (not shown) may rotate. First piston member 326 may include threads 1440 to hold the control ring in place with the lock ring (not shown). Continuing, FIG. 14C shows a bottom distal end view of the first piston member 326 of the downhole adjustable drilling inclination tool 300 in accordance with one or more embodiments of the present invention. Continuing, FIG. 14D shows a cross-sectional side view of the first piston member 326 of the downhole adjustable drilling inclination tool 300 in accordance with one or more embodiments of the present invention. Continuing, FIG. 14E shows a perspective view of the first piston member 326 of the downhole adjustable drilling inclination tool 300 in accordance with one or more embodiments of the present invention.

Figure 15C:
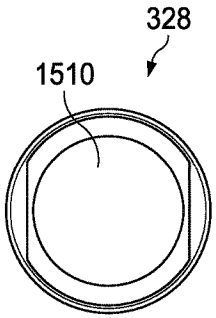
FIGS. 15A, 15B, 15C, 15D, and 15E show a top distal end view, side view, bottom distal end view, cross-sectional side view, and perspective view respectively of a second piston member of a downhole adjustable drilling inclination tool in accordance with one or more embodiments of the present invention.
Figure 15B:
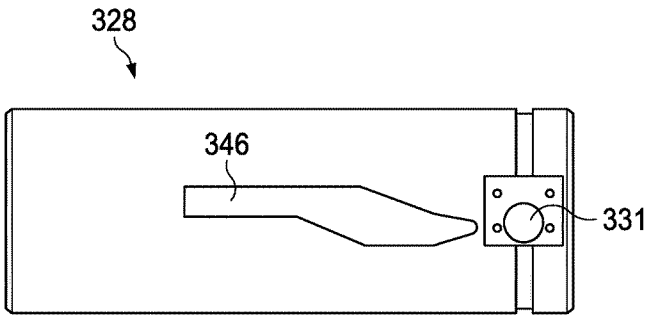
Figure 15A:
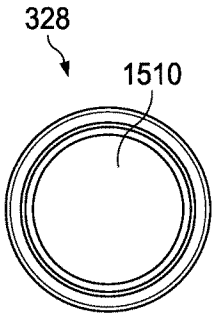
Figure 15E:
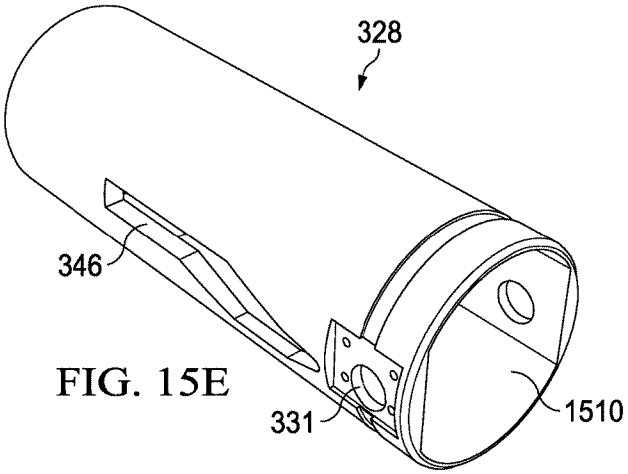
Figure 15D:
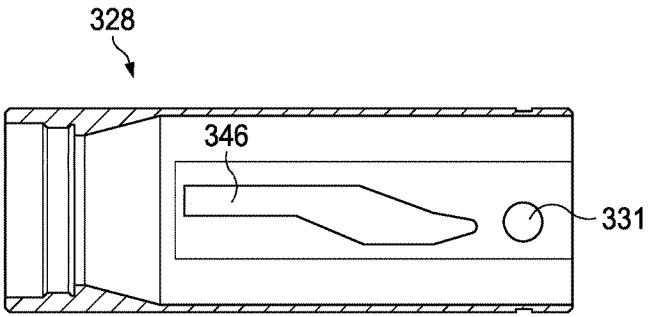

FIG. 15A shows a top distal end view of a second piston member 328 of a downhole adjustable drilling inclination tool 300 in accordance with one or more embodiments of the present invention. Second piston member 328 may include a hollow inner diameter 1510. Continuing, FIG. 15B shows a side view of the second piston member 328 of the downhole adjustable drilling inclination tool 300 in accordance with one or more embodiments of the present invention. Second piston member 328 may include a plurality of lock cam channels 346 (only one side shown) and a plurality of bolt plate pin receivers 331 (only one side shown). Continuing, FIG. 15C shows a bottom distal end view of the second piston member 328 of the downhole adjustable drilling inclination tool 300 in accordance with one or more embodiments of the present invention. Continuing, FIG. 15D shows a cross-sectional side view of the second piston member 328 of the downhole adjustable drilling inclination tool 300 in accordance with one or more embodiments of the present invention. Continuing, FIG. 15E shows a perspective view of the second piston member 328 of the downhole adjustable drilling inclination tool 300 in accordance with one or more embodiments of the present invention.

Figure 16B:
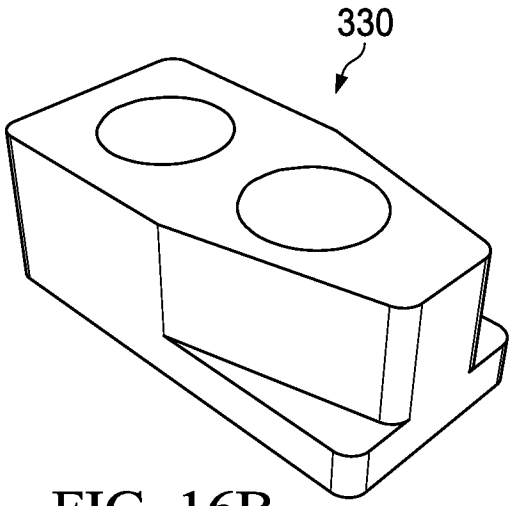
FIGS. 16A and 16B shows a top side view and perspective view respectively of a lock cam of a downhole adjustable drilling inclination tool in accordance with one or more embodiments of the present invention.
Figure 16A:
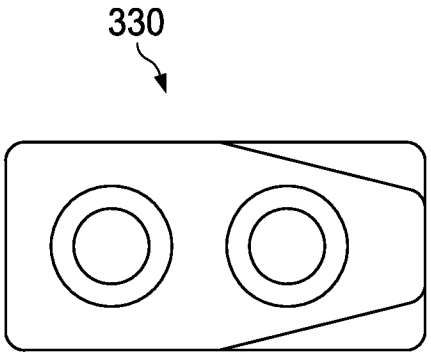

FIG. 16A shows a top side view of a lock cam 330 of a downhole adjustable drilling inclination tool 300 in accordance with one or more embodiments of the present invention. Continuing, FIG. 16B shows a perspective view of the lock cam 330 of a downhole adjustable drilling inclination tool 300 in accordance with one or more embodiments of the present invention.

FIG. 17A shows a right side view of a bolt plate pin 332 of a downhole adjustable drilling inclination tool 300 in accordance with one or more embodiments of the present invention. Bolt plate pin 332 includes a protruding part 1710 that travels in the bolt plate pin channel (not shown) of the tilt housing (not shown). Continuing, FIG. 17B shows a front side view of the bolt plate pin 332 of the downhole adjustable drilling inclination tool 300 in accordance with one or more embodiments of the present invention. Continuing, FIG. 17C shows a left side view of the bolt plate pin 332 of the downhole adjustable drilling inclination tool 300 in accordance with one or more embodiments of the present invention. Continuing, FIG. 17D shows a top side view of the bolt plate pin 332 of the downhole adjustable drilling inclination tool 300 in accordance with one or more embodiments of the present invention. Continuing, FIG. 17E shows a front side perspective view of the bolt plate pin 332 of the downhole adjustable drilling inclination tool 300 in accordance with one or more embodiments of the present invention. Continuing, FIG. 17F shows a rear side perspective view of the bolt plate pin 332 of the downhole adjustable drilling inclination tool 300 in accordance with one or more embodiments of the present invention.

Figure 18A:
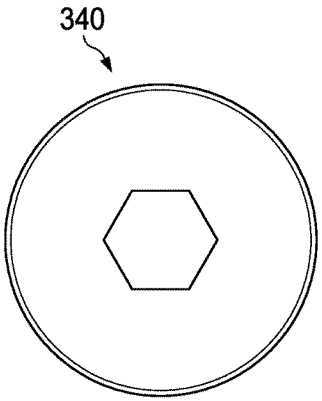
FIGS. 18A, 18B, 18C, and 18D show a top distal end view, side view, bottom distal end view, and perspective view respectively of a fulcrum pin of a downhole adjustable drilling inclination tool in accordance with one or more embodiments of the present invention.
Figure 18B:
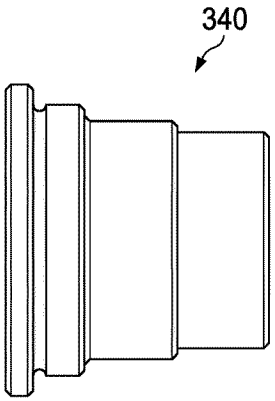
Figure 18C:
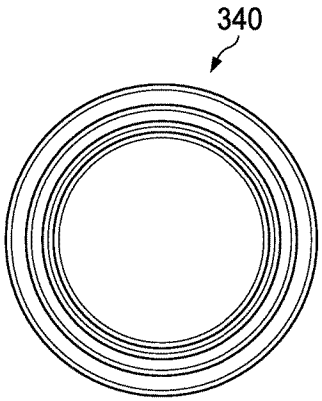
Figure 18D:
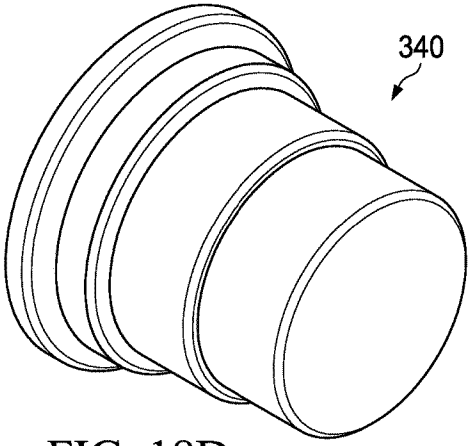

FIG. 18A shows a top distal end view of a fulcrum pin 340 of a downhole adjustable drilling inclination tool 300 in accordance with one or more embodiments of the present invention. Continuing, FIG. 18B shows a side view of the fulcrum pin 340 of the downhole adjustable drilling inclination tool 300 in accordance with one or more embodiments of the present invention. Continuing, FIG. 18C shows a bottom distal end view of the fulcrum pin 340 of the downhole adjustable drilling inclination tool 300 in accordance with one or more embodiments of the present invention. Continuing, FIG. 18D shows a perspective view of the fulcrum pin 340 of the downhole adjustable drilling inclination tool 300 in accordance with one or more embodiments of the present invention.

Figure 19A:
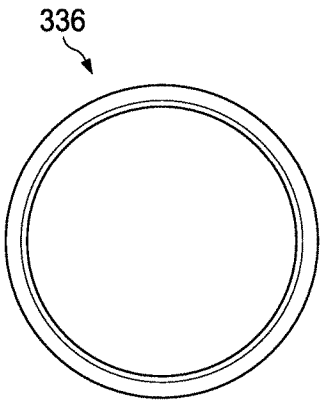
FIGS. 19A, 19B, 19C, 19D, and 19E show a top distal end view, side view, bottom distal end view, cross-sectional side view, and perspective view respectively of a seal ring of a downhole adjustable drilling inclination tool in accordance with one or more embodiments of the present invention.
Figure 19B:
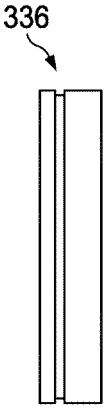
Figure 19C:
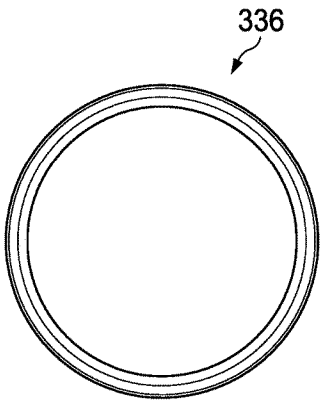
Figure 19D:
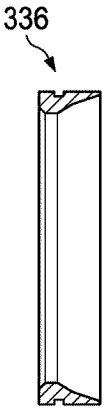
Figure 19E:
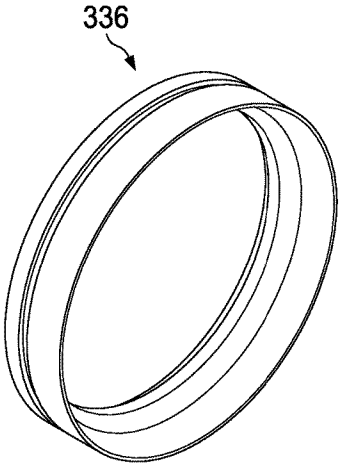

FIG. 19A shows a top distal end view of a seal ring 336 of a downhole adjustable drilling inclination tool 300 in accordance with one or more embodiments of the present invention. Continuing, FIG. 19B shows a side view of the seal ring 336 of the downhole adjustable drilling inclination tool 300 in accordance with one or more embodiments of the present invention. Continuing, FIG. 19C shows a bottom distal end view of the seal ring 336 of the downhole adjustable drilling inclination tool 300 in accordance with one or more embodiments of the present invention. Continuing, FIG. 19D shows a cross-sectional side view of the seal ring 336 of the downhole adjustable drilling inclination tool 300 in accordance with one or more embodiments of the present invention. Continuing, FIG. 19E shows a perspective view of the seal ring 336 of the downhole adjustable drilling inclination tool 300 in accordance with one or more embodiments of the present invention.

Figure 20A:
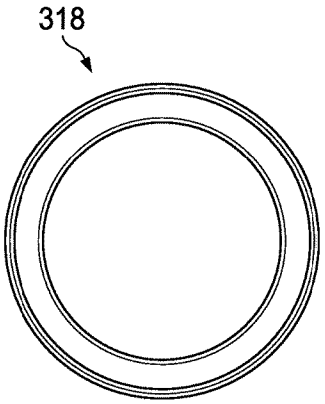
FIGS. 20A, 20B, 20C, 20D, and 20E show a top distal end view, side view, bottom distal end view, cross-sectional side view, and perspective view respectively of a lock ring of a downhole adjustable drilling inclination tool in accordance with one or more embodiments of the present invention.
Figure 20B:
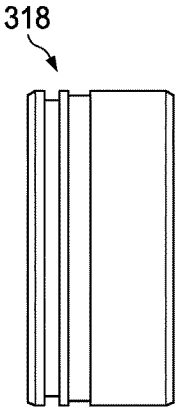
Figure 20C:
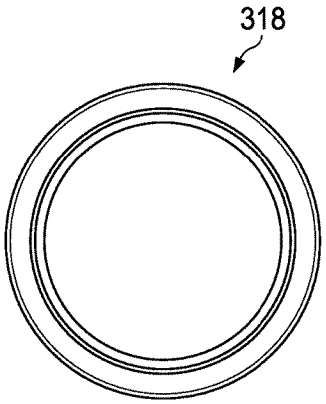
Figure 20D:
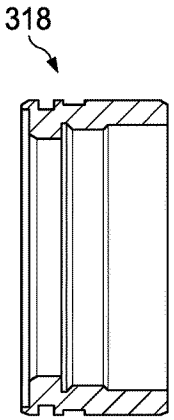
Figure 20E:
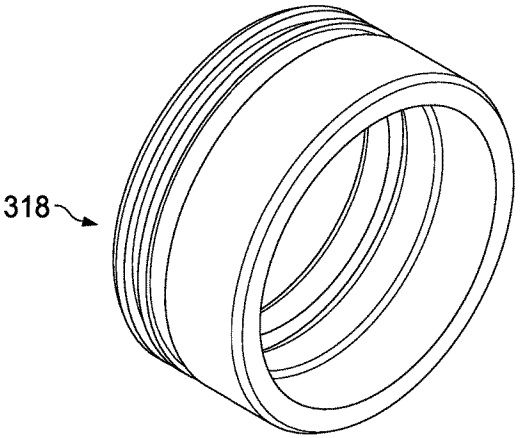

FIG. 20A shows a top distal end view of a lock ring 318 of a downhole adjustable drilling inclination tool 300 in accordance with one or more embodiments of the present invention. Continuing, FIG. 20B shows a side view of the lock ring 318 of the downhole adjustable drilling inclination tool 300 in accordance with one or more embodiments of the present invention. Continuing, FIG. 20C shows a bottom distal end view of the lock ring 318 of the downhole adjustable drilling inclination tool 300 in accordance with one or more embodiments of the present invention. Continuing, FIG. 20D shows a cross-sectional side view of the lock ring 318 of the downhole adjustable drilling inclination tool 300 in accordance with one or more embodiments of the present invention. Continuing, FIG. 20E shows a perspective view of the lock ring 318 of the downhole adjustable drilling inclination tool 300 in accordance with one or more embodiments of the present invention.

In FIGS. 21 through 25, a downhole adjustable drilling inclination tool 300 with a seating ring-type tilting mechanism is shown in accordance with one or more embodiments of the present invention. All prior disclosure provided herein is applicable to the seating ring-type tilting mechanism with minor modification to outer housing 304 and tilt housing 306 and the addition of a seating ring 2310 and a plurality of screws (not shown) used to secure outer housing 304 to seating ring 2310. Accordingly, only those differences are discussed below with reference to FIGS. 21 through 25.

Figure 21:
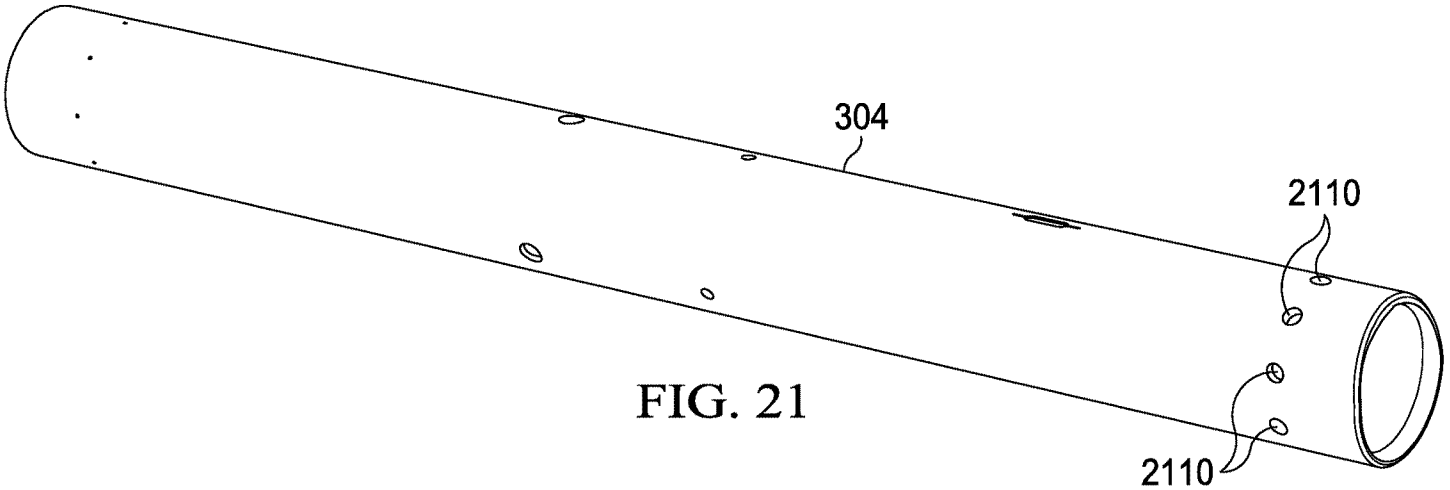
FIG. 21 shows a perspective view of an outer housing (of a seating ring-type tilting mechanism) of a downhole adjustable drilling inclination tool in accordance with one or more embodiments of the present invention.
Figure 22B:
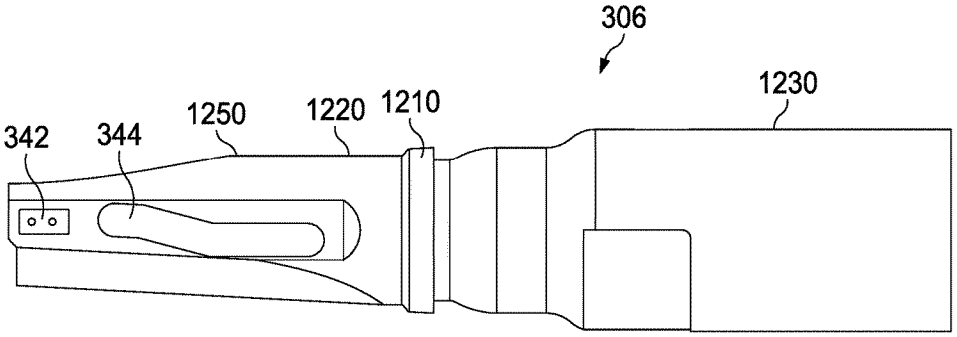
FIGS. 22A, 22B, 22C, 22D, 22E, 22F, 22G, 22H, and 22I show a top distal end view, side view, bottom distal end view, cross-sectional side view, top side view, cross-sectional top side view, bottom side view, top distal end facing perspective view, and bottom distal end facing perspective view, respectively, of a tilt housing (of a seating ring-type tilting mechanism) of a downhole adjustable drilling inclination tool in accordance with one or more embodiments of the present invention.
Figure 22A:
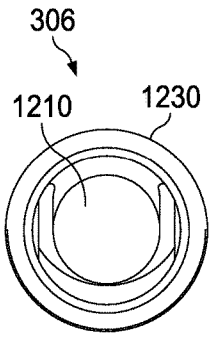
Figure 22C:
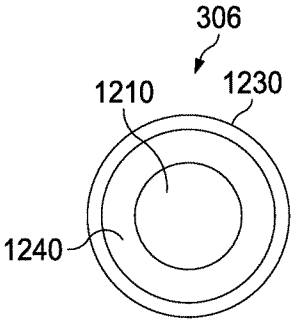
Figure 22D:
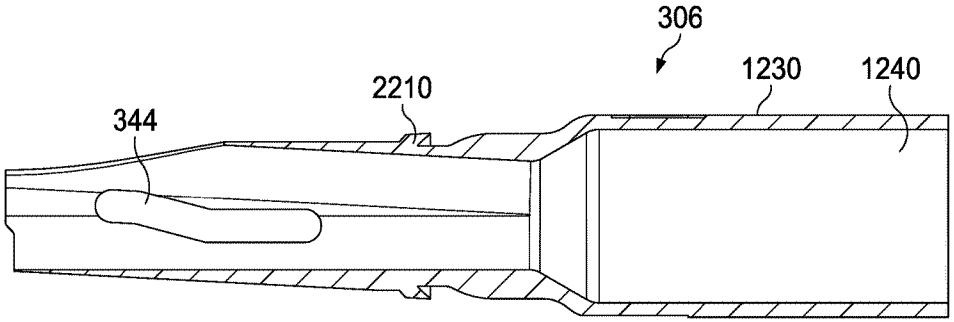
Figure 22E:
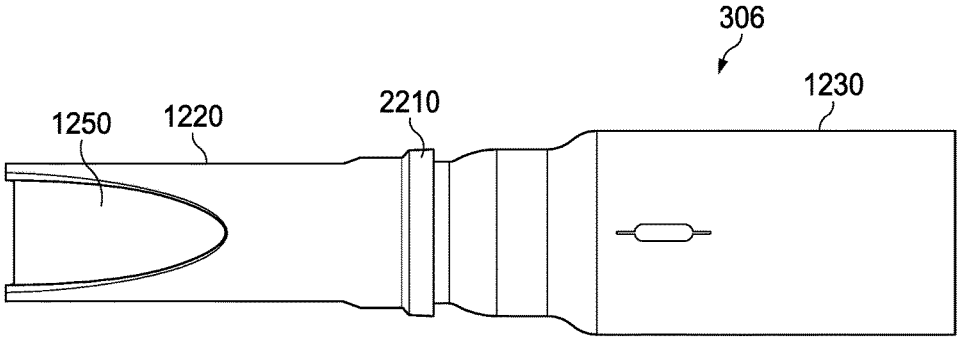
Figure 22F:
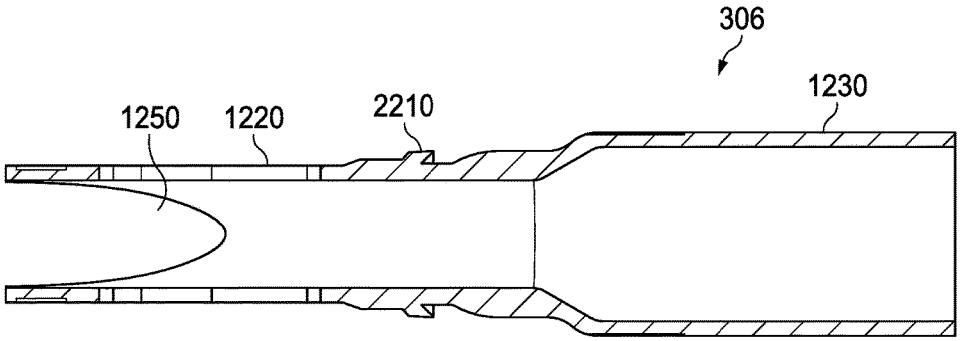
Figure 22G:
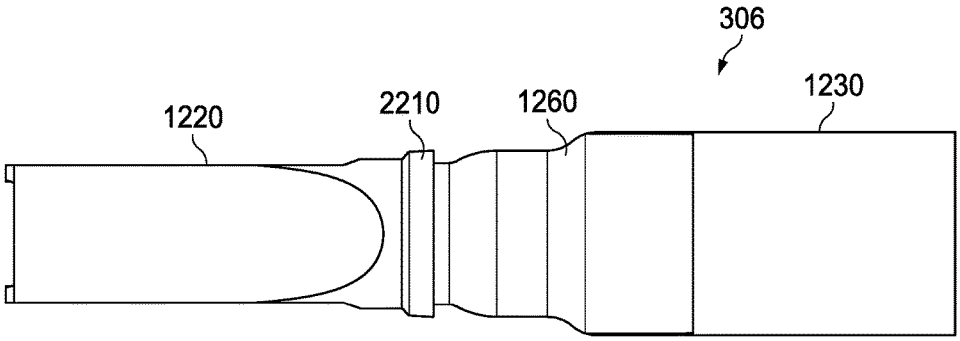
Figure 22I:
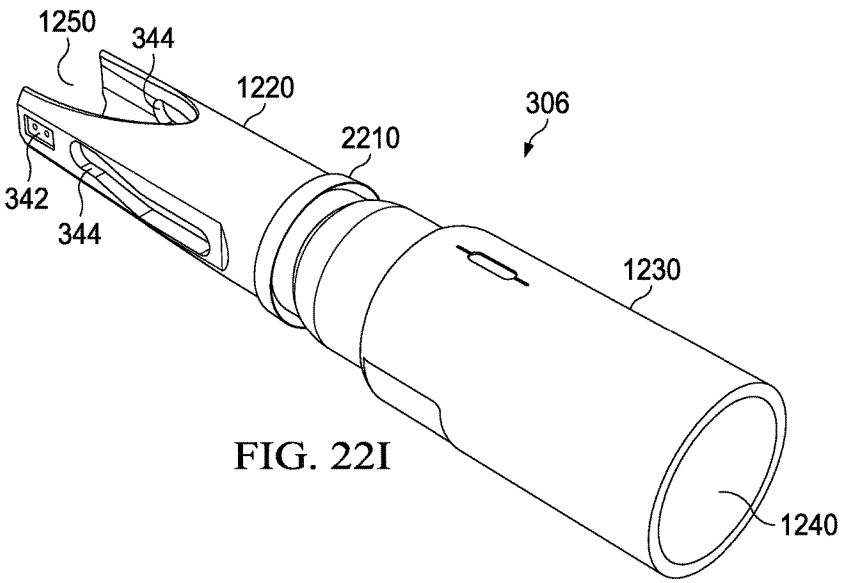
Figure 22H:
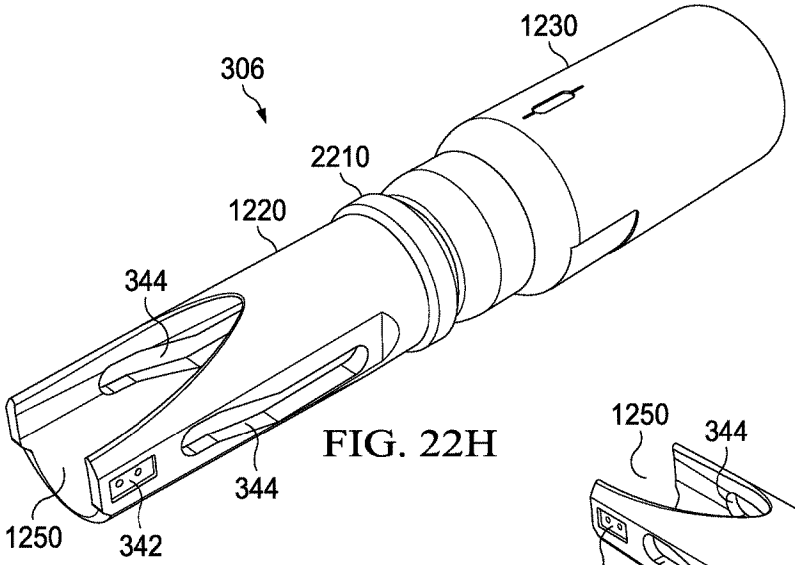
Figure 23B:
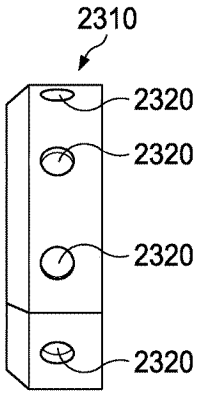
FIGS. 23A, 23B, 23C, and 23D show a top distal end view, side view, perspective view, and alternate perspective view respectively of a seating ring (of a seating ring-type tilting mechanism) of a downhole adjustable drilling inclination tool in accordance with one or more embodiments of the present invention.
Figure 23D:
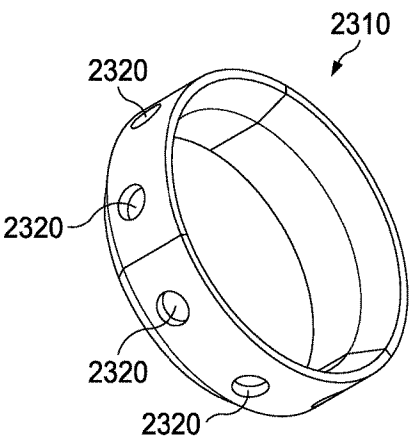
Figure 23A:
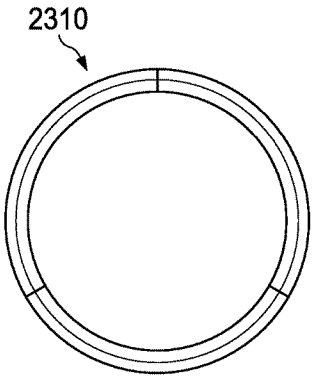
Figure 23C:
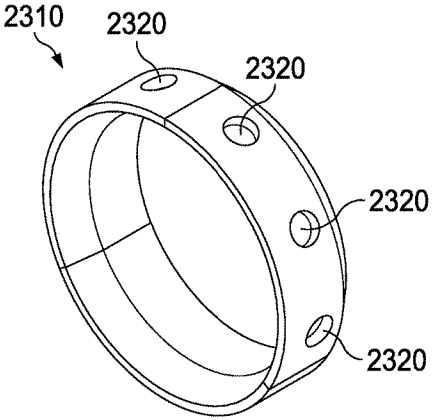

FIG. 21 shows a perspective view of an outer housing (of a seating ring-type tilting mechanism) of a downhole adjustable drilling inclination tool 300 in accordance with one or more embodiments of the present invention. As noted above, outer housing 304 (of a seating ring-type tilting mechanism) differs from outer housing 304 (of a fulcrum pin-type tilting mechanism) by the addition of a plurality of seating ring connection through holes 2110 and the removal of the fulcrum pin ports (1170 of FIG. 11). All other aspects of outer housing 304 remain the same. The plurality of seating ring connection through holes 2110 may be distributed about a circumference of a distal end of outer housing 304 closest to the tilt housing (not shown). One of ordinary skill in the art will recognize that the number and diameter of seating ring connection through holes 2110 may vary in accordance with one or more embodiments of the present invention.

FIGS. 22A, 22B, 22C, 22D, 22E, 22F, 22G, 22H, and 22I show a top distal end view, side view, bottom distal end view, cross-sectional side view, top side view, cross-sectional top side view, bottom side view, top distal end facing perspective view, and bottom distal end facing perspective view, respectively, of a tilt housing 306 (of a seating ring-type tilting mechanism) of a downhole adjustable drilling inclination tool 300 in accordance with one or more embodiments of the present invention. As noted above, tilt housing 306 (of a seating ring-type tilting mechanism) differs from tilt housing 306 (of a fulcrum pin-type tilting mechanism) by the addition of a seating ring shoulder 2210 and the removal of the plurality of fulcrum pin ports (348 of FIG. 12). All other aspects of the tilt housing 306 remain the same. As shown in FIGS. 22B, 22D, 22E, 22F, 22G, 22H, and 22I, seating ring shoulder 2210 provides a circumferential shoulder that is configured to hold a seating ring (not shown) on the bottom side of the tilt housing 306 as it is prevented from substantially moving along the axis of the tool 300 by the seating ring shoulder 2210 and the larger diameter portions of bottom end portion 1230 of tilt housing 306. One of ordinary skill in the art will recognize that the circumferential diameter and shape of the seating ring shoulder 2210 may vary in accordance with one or more embodiments of the present invention.

FIGS. 23A, 23B, 23C, and 23D show a top distal end view, side view, perspective view, and alternate perspective view respectively of a seating ring 2310 (of a seating ring-type tilting mechanism) of a downhole adjustable drilling inclination tool 300 in accordance with one or more embodiments of the present invention. In certain embodiments, seating ring 2310 may be a ring composed of a plurality of parts that allow it to be assembled about a diameter of the tilt housing 306. Seating ring 2310 may include a plurality of seating ring connection blind holes 2320 that are distributed about a circumference of seating ring 2310. The blind holes 2320 extend from an outer diameter, but not all the way through, seating ring 2310. The seating ring connection blind holes 2320 are configured to align with the seating ring connection through holes 2110 of the outer housing, allowing for connection. One of ordinary skill in the art will recognize that the number and diameter of seating ring connection blind holes 2320 may vary in accordance with one or more embodiments of the present invention. Further, one of ordinary skill in the art will recognize that the number of the plurality of parts that comprise seating ring 2310 may vary based on an application or design in accordance with one or more embodiments of the present invention.

Figure 24:
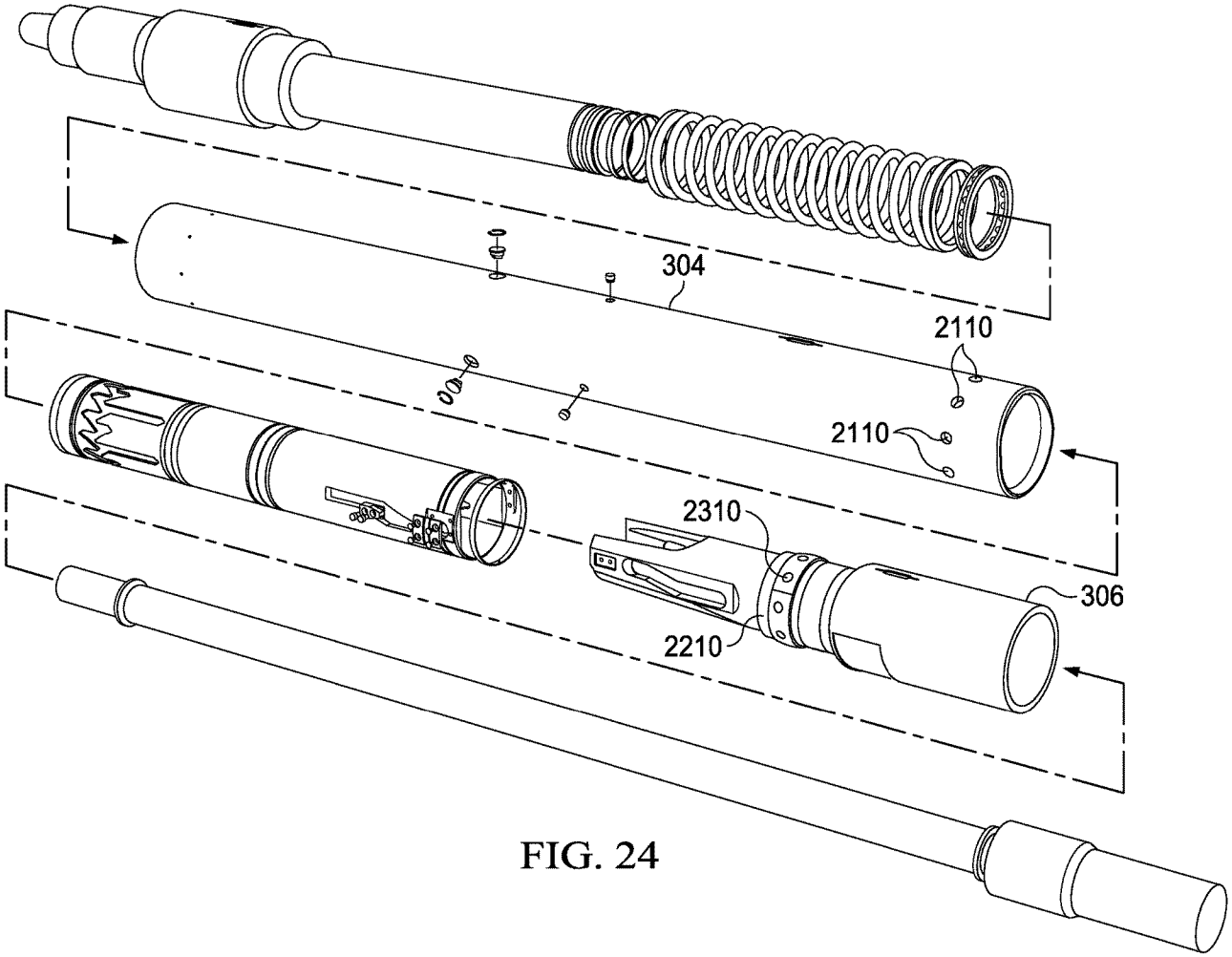
FIG. 24 shows an exploded perspective view of a downhole adjustable drilling inclination tool (of a seating ring-type tilting mechanism) in accordance with one or more embodiments of the present invention.

FIG. 24 shows an exploded perspective view of a downhole adjustable drilling inclination tool (of a seating ring-type tilting mechanism) in accordance with one or more embodiments of the present invention. As noted above, the assembly of the tool 300 remains substantially the same as that disclosed above, with the exception that the seating ring 2310 is assembled about a diameter of tilt housing 306 such that the seating ring 2310 is disposed on a side of seating ring shoulder 2210. For example, once the piston assembly (not shown) is connected to the tilt housing 306, and inserted into the outer housing 304, a plurality of screws may be used to secure outer housing 304 to seating ring 2310. One of ordinary skill in the art will recognize that the assembly process may vary in accordance with one or more embodiments of the present invention.

Figure 25:
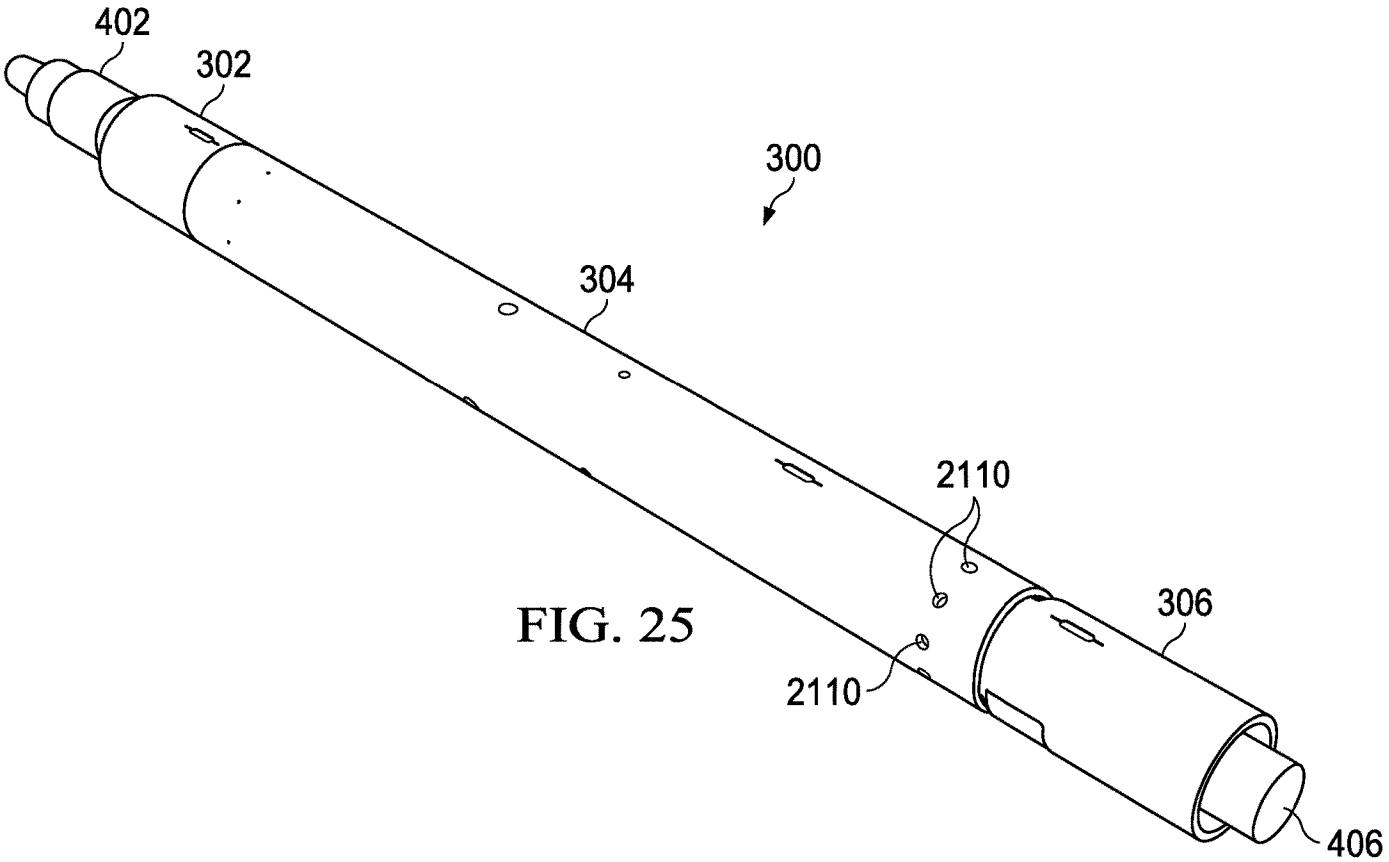
FIG. 25 shows a perspective view of a downhole adjustable drilling inclination tool (of a seating ring-type tilting mechanism) with a tilt housing in a straight or neutral position in accordance with one or more embodiments of the present invention.

FIG. 25 shows a perspective view of a downhole adjustable drilling inclination tool (of a seating ring-type tilting mechanism) with a tilt housing in a straight or neutral position in accordance with one or more embodiments of the present invention.

In one or more embodiments of the present invention, a downhole adjustable drilling inclination tool may include an outer housing that includes a guide pin that extends into an inner diameter, an inner housing that includes a bottom end portion disposed within the outer housing, a compression spring disposed about an outer diameter of the bottom end portion of the inner housing within the outer housing, a piston assembly disposed within the outer housing that is fluidly controlled to move axially along the outer diameter of the bottom end portion of the inner housing so that a rotatable control ring of the piston assembly moves about the guide pin of the outer housing to lock in a neutral, straight, or bent position of the piston assembly corresponding to an amount of compression of the compression spring, and a tilt housing partially disposed within the outer housing that includes a lock cam that travels in a lock cam channel of the piston assembly to tilt the tilt housing by a tilting mechanism that connects the tilt housing to the outer housing and position the tilt housing in a neutral, straight, or bent position of the piston assembly. The downhole adjustable drilling inclination tool is configured so it may receive a drive shaft within an innermost diameter of the tool.

In one or more embodiments of the present invention, a method of adjusting a downhole adjustable drilling inclination tool includes providing a fluid to a bottomhole assembly that includes the downhole adjustable drilling inclination tool disposed in a wellbore, and controlling the pressure of a fluid provided to the bottomhole assembly to achieve a desired fluid pressure difference between the fluid in the downhole adjustable drilling inclination tool and a return fluid in an annulus between an outermost diameter of the downhole adjustable drilling inclination tool and the wellbore. The fluid pressure difference fluidly controls the position of a piston assembly of the downhole adjustable drilling inclination tool between a neutral, straight, or bent position and a corresponding neutral, straight, or bent position of a tilt housing of the downhole adjustable drilling inclination tool. An increase in fluid pressure difference compresses a compression spring and moves the piston assembly axially toward a top of the downhole adjustable drilling inclination tool.

Advantages of one or more embodiments of the present invention may include one or more of the following:

In one or more embodiments of the present invention, a downhole adjustable drilling inclination tool addresses a long-felt gap between the two predominant technologies used in directional drilling. While rotary steerable systems offer a number of advantages, they are cost prohibitive for most drilling projects. For cost constrained projects, fixed-bend systems are commonly used, but they suffer from a number of disadvantages that contraindicate their use. As such, there is long-felt, but unsolved, need in the industry to provide a simple, inexpensive, and reliable directional drilling tool that can accommodate larger diameter drive shafts used in modern high-torque mud motors. The downhole adjustable drilling inclination tool is simple, inexpensive, and more reliable than existing fixed-bend, downhole-adjustable, and rotary steerable systems. In addition, the downhole adjustable drilling inclination tool does not bend the drive shaft and can accommodate larger diameter drive shafts used in modern high-torque mud motors. As such, the downhole adjustable drilling inclination tool may be used across the spectrum of drilling applications, but is particularly attractive for less expensive rigs.

In one or more embodiments of the present invention, a downhole adjustable drilling inclination tool brings downhole adjustability to less expensive rigs and cost constrained drilling projects. The downhole adjustable drilling inclination tool may be used instead of fixed-bend systems and reduce the expense associated with tripping the drill string between straight drilling operations and directional drilling operations.

In one or more embodiments of the present invention, a downhole adjustable drilling inclination tool is fluidly configurable and allows for switching between straight drilling and directional drilling without tripping the drill string. The downhole adjustable drilling inclination tool may be used in a straight position that allows for straight drilling operations. When a kickoff is desired, the downhole adjustable drilling inclination tool may be fluidly configured to a bent position that allows for directional drilling operations.

In one or more embodiments of the present invention, a downhole adjustable drilling inclination tool improves the safety of directional drilling operations. By reducing the number of trips required for the drill string during directional drilling operations, safety is improved and exposure to environmental hazards is reduced.

In one or more embodiments of the present invention, a downhole adjustable drilling inclination tool may include an electronics package to be incorporated into the downhole adjustable drilling inclination tool to indicate the position of the tilt housing in the neutral, straight, or bent positions.

In one or more embodiments of the present invention, a downhole adjustable drilling inclination tool may include modified components that allow for the fluid control of the tilt housing between a number of bent positions corresponding to a number of different inclination angles of the drive shaft assembly, such that the degree of bend could be fluidly controlled.

In one or more embodiments of the present invention, a downhole adjustable drilling inclination tool improves the quality and the integrity of the wellbore when compared to a bent sub or bent housing tool.

In one or more embodiments of the present invention, a downhole adjustable drilling inclination tool provides improved weight on bit than a bent sub or bent housing tool.

In one or more embodiments of the present invention, a downhole adjustable drilling inclination tool provides improved rate of penetration because the drill string does not have to be tripped between straight and directional drilling operations.

In one or more embodiments of the present invention, a downhole adjustable drilling inclination tool is less complex than conventional directional drilling tools other than bent sub or bent housing tools.

In one or more embodiments of the present invention, a downhole adjustable drilling inclination tool is less expensive than conventional directional drilling tools.

In one or more embodiments of the present invention, a downhole adjustable drilling inclination tool is easier to operate than conventional directional drilling tools.

In one or more embodiments of the present invention, a downhole adjustable drilling inclination tool reduces operational costs and does not require as highly skilled operators as conventional directional drilling tools.

In one or more embodiments of the present invention, a downhole adjustable drilling inclination tool is more reliable than conventional directional drilling tools.

In one or more embodiments of the present invention, a downhole adjustable drilling inclination tool reduces the tilt-to-bit such that the tilt is close to the drill bit than conventional directional drilling tools.

In one or more embodiments of the present invention, a downhole adjustable drilling inclination tool provides a smaller radius well trajectory than conventional directional drilling tools.

In one or more embodiments of the present invention, a downhole adjustable drilling inclination tool does not bend the drive shaft as some conventional directional drilling tools do.

In one or more embodiments of the present invention, a downhole adjustable drilling inclination tool is scalable to accommodate drilling operations with different wellbore diameters.

In one or more embodiments of the present invention, a downhole adjustable drilling inclination tool can accommodate larger diameter drive shafts used in modern high-torque mud motors.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A downhole adjustable drilling inclination tool comprising:

an outer housing comprising a guide pin that extends into an interior of the outer housing;

an inner housing comprising a bottom end portion disposed within the outer housing;

a compression spring disposed about an exterior surface of the bottom end portion of the inner housing within the outer housing;

a piston assembly disposed within the outer housing that is fluidly controlled to move along the exterior surface of the bottom end portion of the inner housing so that a rotatable control ring moves about the guide pin of the outer housing to hold a neutral, straight, or bent position of the piston assembly corresponding to an amount of compression of the compression spring; and a tilt housing partially disposed within the outer housing that includes a bolt plate channel configured to receive a bolt plate pin of the piston assembly that travels in the bolt plate channel to tilt the tilt housing by a tilting mechanism that connects the tilt housing to the outer housing and positions the tilt housing in a neutral, straight, or bent position corresponding to the neutral, straight, or bent position of the piston assembly, wherein the downhole adjustable drilling inclination tool is configured to receive a drive shaft within an innermost diameter of the tool.

2. The downhole adjustable drilling inclination tool of claim 1, wherein the tilting mechanism comprises a plurality of fulcrum pins that connects the tilt housing to the outer housing through a plurality of fulcrum pin ports of the tilt housing into a plurality of fulcrum pin ports of the outer housing.

3. The downhole adjustable drilling inclination tool of claim 1, wherein the tilting mechanism comprises a seating ring disposed about an exterior surface of the tilt housing on a side of a seating ring shoulder of the tilt housing that connects the tilt housing to the outer housing, and wherein a plurality of screws connect the outer housing to the seating ring.

4. The downhole adjustable drilling inclination tool of claim 1, the outer housing further comprising:

a plurality of guide pins that extend into the interior of the outer housing.

5. The downhole adjustable drilling inclination tool of claim 1, the inner housing further comprising:

a substantially cylindrical member with a top end portion having a top distal end opening configured to receive a portion of a top drive shaft coupling through a first inner diameter and a second inner diameter through which the drive shaft is disposed.

6. The downhole adjustable drilling inclination tool of claim 1, the piston assembly further comprising:

a first piston member about which the rotatable control ring rotates;

a second piston member connected to the first piston member, the second piston member comprising a bolt plate pin receiver and a lock cam channel; and the bolt plate pin configured to extend through the bolt plate pin receiver of the second piston member into the bolt plate channel of the tilt housing.

7. The downhole adjustable drilling inclination tool of claim 1, the tilt housing further comprising:

a top end portion comprising the bolt plate channel, a lock cam that travels in a lock cam channel of the piston assembly, and a cutout to allow for movement of the drive shaft when the tilt housing is in the bent position; and a bottom end portion having an interior, the bottom end portion being configured to receive the drive shaft through an interior of the bottom end portion.

8. The downhole adjustable drilling inclination tool of claim 1, wherein at least a portion of the inner housing, the compression spring, the piston assembly, and the tilt housing are disposed within the interior of the outer housing.

9. The downhole adjustable drilling inclination tool of claim 1, wherein the drive shaft is disposed within the innermost diameter of the tool and a top drive shaft coupling is exposed out of a top distal end of the inner housing and a bottom drive shaft coupling is exposed out of a bottom distal end of the tilt housing.

10. The downhole adjustable drilling inclination tool of claim 1, wherein a top drive shaft coupling couples a top end of the drive shaft to a power section and a bottom drive shaft coupling couples a bottom end of the drive shaft to a bearing assembly or a combination bearing and drill bit assembly.

11. The downhole adjustable drilling inclination tool of claim 1, wherein the tilt housing, in the bent position, provides an inclination angle in a range between 0 degrees and 3 degrees inclusive from a longitudinal centerline of the outer housing of the tool.

12. The downhole adjustable drilling inclination tool of claim 1, wherein a fluid pressure difference between a fluid pressure through an innermost interior of the tool and a fluid pressure in an annulus between an outermost exterior of the tool and a wellbore fluidly controls the position of the piston assembly in the neutral, straight, or bent position and the corresponding neutral, straight, or bent position of the tilt housing.

13. The downhole adjustable drilling inclination tool of claim 1, wherein an increase in a fluid pressure difference between a fluid pressure through an innermost interior of the tool and a fluid pressure in an annulus between an outermost exterior of the tool and a wellbore compresses the compression spring and moves the piston assembly along a longitudinal axis toward a top of the downhole adjustable drilling inclination tool.

14. A method of adjusting a downhole adjustable drilling inclination tool comprising:

providing a fluid to a bottomhole assembly comprising the downhole adjustable drilling inclination tool disposed in a wellbore; and controlling the pressure of the fluid provided to the bottomhole assembly to achieve a desired fluid pressure difference between the fluid in the downhole adjustable drilling inclination tool and return fluid in an annulus between an outermost diameter of the downhole adjustable drilling inclination tool and the wellbore, wherein the fluid pressure difference fluidly controls the position of a piston assembly of the downhole adjustable drilling inclination tool between a neutral, straight, or bent position and a corresponding neutral, straight, or bent position of a tilt housing of the downhole adjustable drilling inclination tool, and wherein the tilt housing is partially disposed within an outer housing that includes a bolt plate channel configured to receive a bolt plate pin of the piston assembly that travels in the bolt plate channel to tilt the tilt housing by a tilting mechanism that connects the tilt housing to the outer housing and positions the tilt housing in a neutral, straight, or bent position corresponding to the neutral, straight, or bent position of the piston assembly.

15. The method of claim 14, wherein an increase in fluid pressure difference compresses a compression spring and moves the piston assembly along a longitudinal axis toward a top of the downhole adjustable drilling inclination tool.

16. The method of claim 14, wherein the tilt housing, in the bent position, provides an inclination angle in a range between 0 degrees and 3 degrees inclusive from a longitudinal axis of the tool.

* * * * *